US009765955B2

(12) United States Patent
Liu et al.

(10) Patent No.: US 9,765,955 B2
(45) Date of Patent: Sep. 19, 2017

(54) LED CANDLE BULB AND LED CANDLE LIGHT

(75) Inventors: Yuan Liu, Vancouver (CA); Qing Charles Li, Las Vegas, NV (US)

(73) Assignee: Organo Bulb, Inc., Dallas, TX (US)

( * ) Notice: Subject to any disclaimer, the term of this patent is extended or adjusted under 35 U.S.C. 154(b) by 376 days.

(21) Appl. No.: 14/129,119

(22) PCT Filed: Jun. 25, 2012
(Under 37 CFR 1.47)

(86) PCT No.: PCT/US2012/043981
§ 371 (c)(1),
(2), (4) Date: Aug. 26, 2014

(87) PCT Pub. No.: WO2012/178155

PCT Pub. Date: Dec. 27, 2012

(65) Prior Publication Data

US 2015/0043211 A1 Feb. 12, 2015

Related U.S. Application Data

(60) Provisional application No. 61/501,096, filed on Jun. 24, 2011, provisional application No. 61/617,920, filed on Mar. 30, 2012.

(51) Int. Cl.
*F21V 29/00* (2015.01)
*F21V 17/06* (2006.01)
(Continued)

(52) U.S. Cl.
CPC ..... *F21V 29/22* (2013.01); *F21K 9/232* (2016.08); *F21V 3/02* (2013.01); *F21V 23/009* (2013.01); *F21V 29/70* (2015.01); *F21S 6/001* (2013.01)

(58) Field of Classification Search
CPC ..... F21S 6/001; F21K 9/135; F21K 9/232; F21V 23/009; F21V 17/00; F21V 17/12
See application file for complete search history.

(56) References Cited

U.S. PATENT DOCUMENTS

2008/0062703 A1 3/2008 Cao
2009/0213597 A1 8/2009 Nelkin
(Continued)

FOREIGN PATENT DOCUMENTS

WO 2006020839 A 2/2006
WO 2010044985 A2 4/2010
WO 2010079439 A1 7/2010

OTHER PUBLICATIONS

Co-Pending International Application No. PCT/US2012/043981, International Preliminary Report on Patentability, dated Jan. 9, 2014, 9 pages.
(Continued)

*Primary Examiner* — Karabi Guharay
(74) *Attorney, Agent, or Firm* — Michele Mayberry; Jeremy M. Stipkala

(57) ABSTRACT

The present invention is directed generally to electric lighting, and more particularly to a light emitting diode (LED) candle bulb and LED candle light. More particularly, the present invention relates to a candle light assembly comprising: a bulb enclosing a volume and having an opening at a longitudinal end, wherein the opening has an interior circumference which is threaded; a heat sink base with an opening at a longitudinal end, wherein the opening has an interior circumference which is threaded; a connector for securing the bulb to the heat sink base, which has an upper exterior threaded portion for communicating with the threaded bulb and a lower exterior threaded portion for communicating with the threaded base; and an optics assembly comprising an LED, a lens, and a drive circuit for operating the LED. The LED candle lights according to embodiments of the invention can provide bright lighting similar to that of traditional incandescent candle light without overheating.

9 Claims, 29 Drawing Sheets

(51) Int. Cl.

| | |
|---|---|
| ***F21V 3/02*** | (2006.01) |
| ***F21V 23/00*** | (2015.01) |
| ***F21V 29/70*** | (2015.01) |
| ***F21K 9/232*** | (2016.01) |
| *F21S 6/00* | (2006.01) |

(56) References Cited

U.S. PATENT DOCUMENTS

| | | | | |
|---|---|---|---|---|
| 2010/0001662 | A1 | 1/2010 | Nelkin et al. | |
| 2010/0097821 | A1 | 4/2010 | Huang et al. | |
| 2011/0089861 | A1 | 4/2011 | Zeng et al. | |
| 2011/0215345 | A1* | 9/2011 | Tarsa | F21K 9/135 257/88 |

OTHER PUBLICATIONS

Co-Pending International Application No. PCT/US2012/043981, International Search Report and Written Opinion, dated Dec. 26, 2012, 12 pages.

Extended European Search Report in European Patent Application No. 12802731.5, dated Jan. 28, 2015 (8 pages).

Office Action from Russian Patent Office for Russian Application No. 2014 102 108, dated Mar. 28, 2016 (5 pages).

Communication from European Patent Office for EP 12 802 731.5, mailed Jan. 18, 2016 (6 pages).

Communication from European Patent Office indicating Intention to Grant European Patent in European Application No. EP 12 802 731.5, dated Dec. 13, 2016 (7 pages).

* cited by examiner

Radiator simulation:

Temperature increase: 37.5°C

Environment Temperature: 26°C

LED CANDLE BULB AND LED CANDLE LIGHT

CROSS-REFERENCE TO RELATED APPLICATIONS

This application is a National Stage application under 35 USC §371 of application Ser. No. PCT/US12/43,981, filed Jun. 25, 2012, which application claims priority to and the benefit of the filing dates of U.S. Provisional Patent Application Nos. 61/501,096 and 61/617,920, filed on Jun. 24, 2011 and Mar. 30, 2012 respectively, the disclosures of which are hereby incorporated by reference herein in their entireties.

BACKGROUND OF THE INVENTION

Field of the Invention

The present invention relates generally to electric lighting, and more particularly to a light emitting diode (LED) candle bulb and LED candle light.

Description of Related Art

Traditional incandescent lamps or light bulbs suffer from a variety of shortcomings, including but not limited to, inefficient use of energy and limited lifespans. Other type of lamps, such as compact fluorescent lamps and LED lighting have become increasingly popular and have aided in helping with some of the above limitations. These newer forms of lighting present their own challenges. For example, challenges related to LED lighting applications relate to heat dissipation and space limitations. The space limitations are even more challenging when trying to make a stylishly shaped light bulb. For years, prior to the invention of light bulbs, candles where a stylish and fancy form of lighting. In recent years, many light bulbs have been shaped as stylish candles. Accordingly, it would be useful to have a LED based light bulb that is both a stylish candlelight and with improved lighting components.

Thus, there remains a need for an improved LED candle bulb and light. It is to the provision of an improved LED candle light and bulb, and systems and methods related thereto, meeting these and other needs that the present invention is primarily directed.

SUMMARY OF THE INVENTION

Embodiments of the present invention relate generally to electric lighting, and more particularly to a light emitting diode (LED) candle type bulb and LED candle light.

In certain embodiments, the present invention provides a light assembly comprising: a candle bulb enclosing a volume and having an opening at a longitudinal end, a lens placed proximate to the opening in the candle bulb, an LED light source placed proximate to the opening in the lens for emitting light into the candle bulb, a lamp cap forming the candle bulb base, a heat sink and a connector that connects the LED light source to the heat sink and allows for efficient heat dissipation.

In another embodiment the current invention provides a method of providing light comprising: providing a light assembly that comprises: a candle bulb enclosing a volume and having an opening at a longitudinal end, a lens placed proximate to the opening in the candle bulb, a LED light source placed proximate to the opening in the lens for emitting light into the candle bulb, a lamp cap forming the candle bulb base, a heat sink, and a connector that connects the LED light source to the heat sink; electrically powering the LED light source; dissipating the heat generated by the LED light source through the connector with the heat sink; collecting the light emitted by the LED light source through the lens to the inside the candle bulb; and transmitting and scattering the collected light to produce light similar to traditional incandescent candle light.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention. The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

FIG. 11 is a photo of a candle light according to the invention that is turned on.

DETAILED DESCRIPTION OF PREFERRED EMBODIMENTS

In accordance with embodiments of the present invention, provided are light emitting diode (LED) type candle bulbs and LED candle lights.

Existing candle light LED assemblies, such as that disclosed in US Published Application Nos. 2009/0213597 and 2010/0001662, which are incorporated by reference herein in their entireties, and which generally disclose an LED candelabra, do not have an efficient means for dissipating heat from the system and do not have the type of soft lighting provided by conventional incandescent candle-type bulbs. One of the many advantages of the present invention is that in embodiments of the candle light LED assemblies disclosed herein, the bulb and heat sink are not integral. Nonetheless, the heat sink incorporated in the present invention is capable of efficiently dissipating heat away from the LED light. In embodiments, there is no heat sink component to the bulb itself, which is different from existing candle-like bulbs where the heat sink is incorporated directly into the bulb, such as that disclosed in US Published Application No. 2010/0097821, the disclosure of which is hereby incorporated by reference herein in its entirety. The heat sink in embodiments of the present invention provides a decorative candle like appearance. Another advantage is that certain embodiments of the invention may include candle light LED assemblies operably configured to produce light similar to traditional incandescent candle light.

Figure 1:
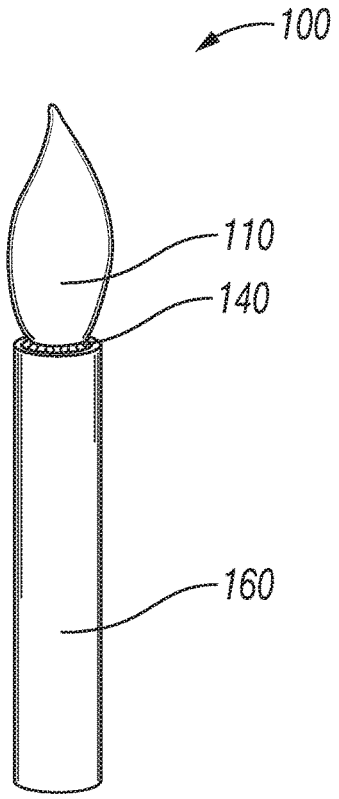
FIG. 1 is a schematic diagram illustrating a top front perspective view of an LED candle light assembly and candle bulb of the invention.
Figure 2:
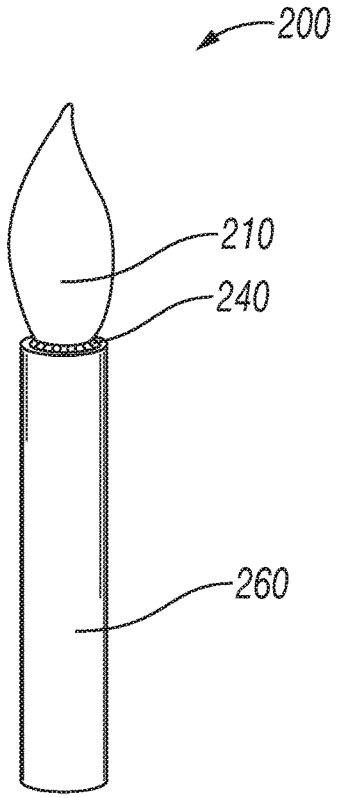
FIG. 2 is a schematic diagram illustrating a front elevation view of an LED candle light assembly and candle bulb of the invention.

Referring now to the Figures, FIGS. 1 and 2, respectively are schematic diagrams illustrating a top front perspective view and a front elevation view of an LED candle light assembly and candle bulb of the invention. As shown, candle light 100/200 comprises a globe 110/210 (otherwise referred to as a bulb), a lens 120/220 and LED light source 130/230 encompassed by globe 110/210 (and not visible in the drawing), a connector 140/240, and LED heat sink 160/260. In such a configuration, heat generated by LED 130/230 is transferred to connector 140/240 with which the LED is in physical contact. The connector 140/240 also serves as securing means for attaching globe 110/210 to heat sink 160/260 and for securing lens 120/220 and LED 130/230 within the globe 110/210. As shown in this embodiment, connector 140/240 comprises through holes disposed around the circumference of the connector to further facilitate dissipation of heat. Heat sink 160/260 is configured as a candle stick for aesthetic purposes as well as for heat dissipation purposes. The elongated shape of the heat sink 160/260 allows for efficient dissipation of heat along the length of the shaft material. The heat sink 160/260 can be solid, hollow, or a combination thereof.

Figure 3:
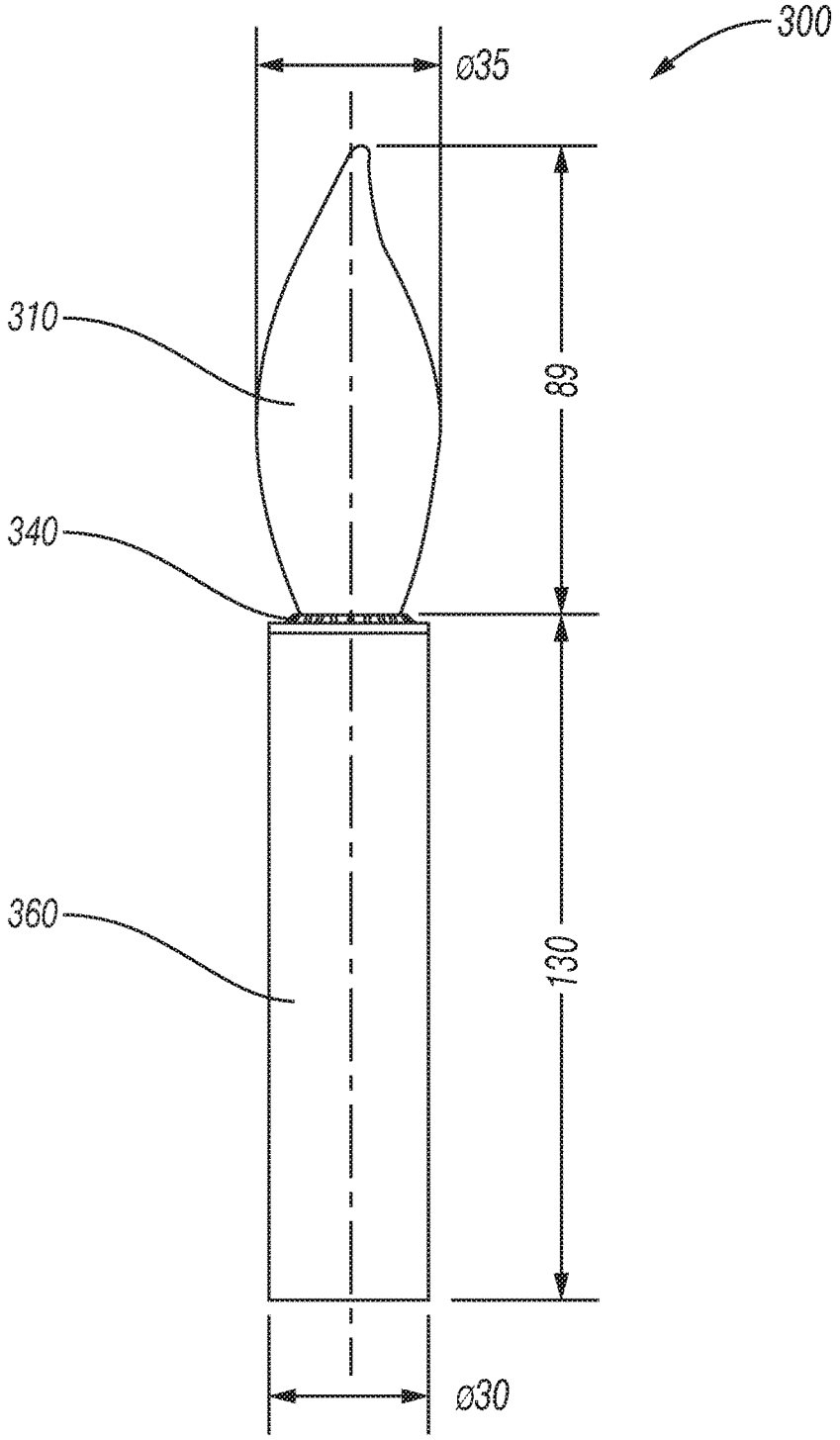
FIG. 3 is a schematic diagram of representative size illustrating an LED candle light assembly and candle bulb of the invention.

FIG. 3 is a schematic diagram illustrating a representative LED candle light assembly and candle bulb of the invention. The assembly 300 can comprise a bulb 310 with an outermost diameter ranging from about 10 mm to about 80 mm, such as about 35 mm, which is shown. Generally, the outermost diameter of the bulb 310 measures about half the height of the bulb 310, or slightly less than half the height. Thinner bulbs 310 may also be desired for particular applications, such as having an outer diameter of about 10%, 20%, 25%, 30%, or 33% of the height of the bulb. The bulb 310 may also be about 30 mm to about 150 mm in height, such as about 89 mm as shown. In embodiments, no bulb is required. Likewise, the heat sink 360 can range in height from about 50 mm to about 250 mm, such as about 130 mm as shown. Typically, the bulb 310 to heat sink 360 height ratio ranges from about 1:1 to about 1:5, while higher ratios may be preferred for applications where higher intensity LEDs are used which give off a substantial amount of heat and for which a longer heat sink 360 is needed to dissipate the heat. The diameter of the heat sink 360 can also be altered, if desired, to allow for greater of lesser heat sink capabilities. A typical range for heat sink 360 diameter is about 10 mm to about 80 mm, and for example about 30 mm as shown. The height of the bulb 310 and heat sink 360, as well as the diameter of the bulb 310 and heat sink 360 are not critical and one of skill in the art with the benefit of this disclosure would know how to alter the dimensions for a particular application. The heat sink has a length of from about 100 mm to about 200 mm, such as about 130 mm, as shown. The outer diameter of the heat sink can range from about 10 mm to about 60 mm, such as about 30 mm, as shown.

Figure 4:
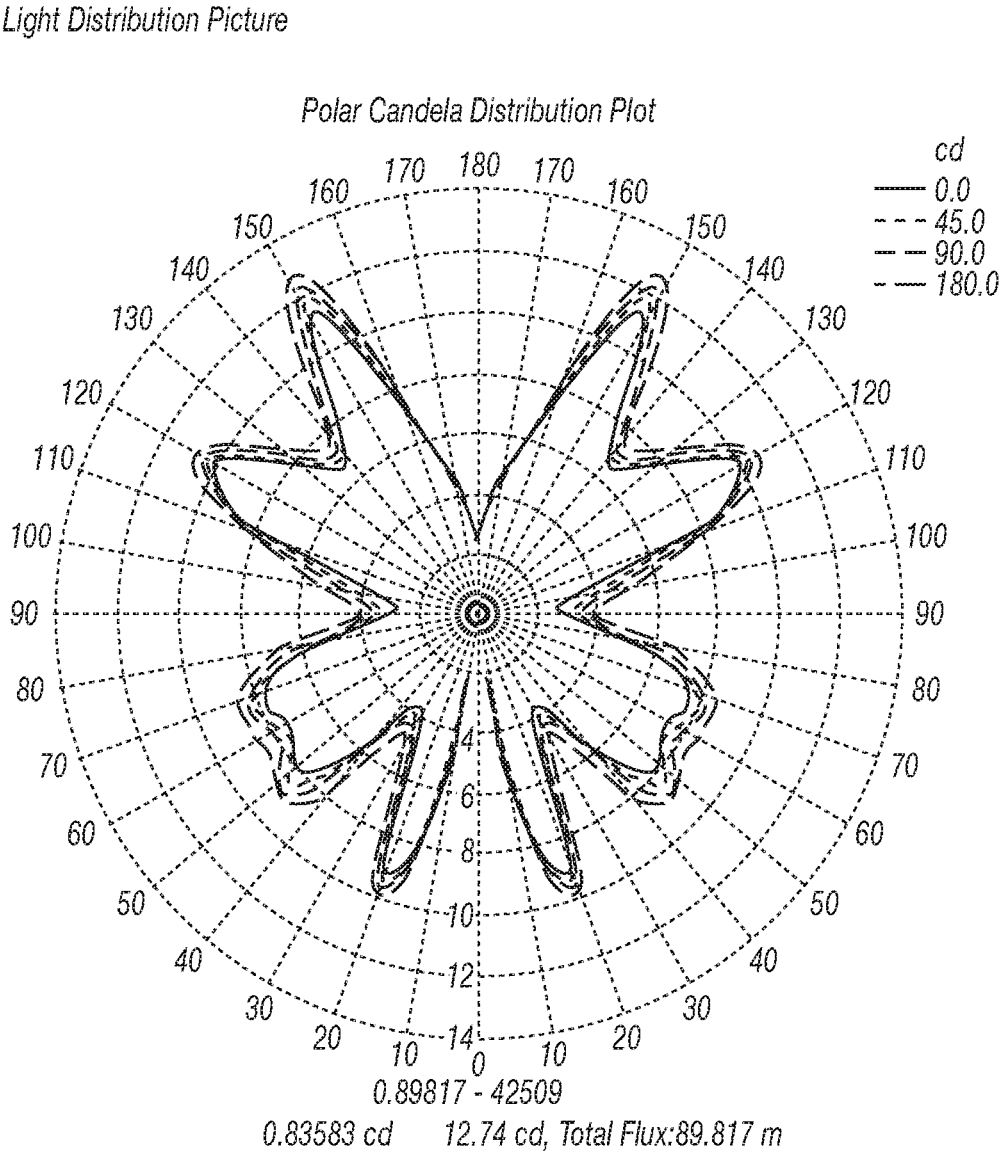
FIG. 4 is a plot illustrating light distribution for an LED candle light assembly and candle bulb of the present invention.

FIG. 4 is a plot illustrating light distribution for an LED candle light assembly and candle bulb of the present invention. In certain embodiments, the LED and lens selected for a particular lighting effect may be operably configured to provide a light viewing angle of from about 60 to about 360 degrees. In preferred embodiments, the lens may be operably configured to provide a light viewing angle of about 300 degrees. One of ordinary skill in the art, with the benefit of this disclosure, would know the type and shape of lens to use for a particular application for providing the desired lighting effect. In other preferred embodiments, the light viewing angle can be from about 70-350 degrees, such as from about 75-340 degrees, such as from about 80-330 degrees, or from about 85-320 degrees, or from about 90-310 degrees, even further from about 100-305 degrees, such as from about 110-290 degrees, or from about 120-280 degrees, or from about 130-270 degrees, or from about 145-250 degrees, such as from about 150-240 degrees, or from about 160-230 degrees, or from about 170-220 degrees, or from about 180-210 degrees, such as from about 190-205 degrees, or a viewing angle of about 200 degrees.

Figure 5:
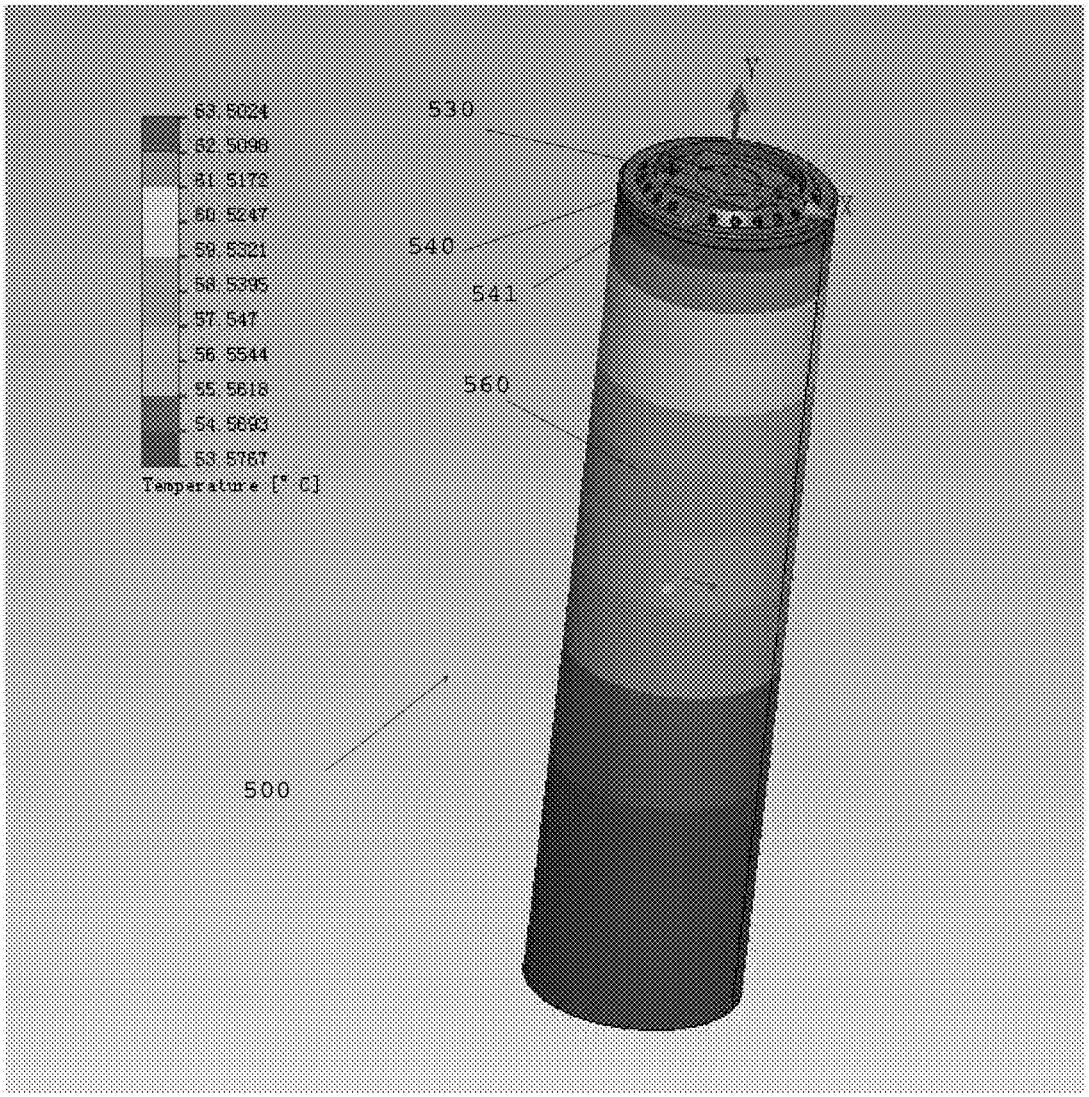
FIG. 5 is a graphical representation illustrating the heat sink simulation of the temperature in an LED candle light assembly of the present invention.

FIG. 5 is a graphical representation illustrating the heat sink simulation of the temperature in an LED candle light assembly of the present invention. As shown, a representative heat sink 560 of a candle light 500 according to the invention absorbs heat from the LED 530 when the LED is illuminated. As demonstrated in FIG. 5, heat transfer occurs from the LED 530 to the connector 540 to which it is in physical contact with. Typically, the underside of a chip type LED 530 is disposed on the upper surface of the connector 540 and there may be direct contact between these surfaces. Alternatively, there may be indirect contact between these surfaces if using an intermediate thermal conduction material. LED 530 can further be secured to the connector using screws, if desired, or other means that will not disrupt the heat transfer properties between the surface of the LED 530 and the surface of the connector 540. Heat is then dissipated by way of through holes 541 in the connector and by heat transfer to the body of the heat sink 560. The connector 540 and heat sink 560 can physically contact one another through various means, including by a threaded connection and/or a friction fit. As demonstrated in FIG. 5, when the candle light 500 is not illuminated, the components of the system have the same or about the same temperature as the environment in which they are disposed. Here, the components begin at approximately an atmospheric temperature of about 26 degrees C. When the LED 530 is illuminated a maximum temperature increase of about 37.5 degrees C. is realized. This is the temperature of LED 530, the connector 540, and an upper portion of the heat sink 560. As heat is transferred along the length of the candle stick shaped heat sink shaft 560, the temperature of the heat sink 560 is lower near its base. Thus, a maximum temperature for the LED 530 when illuminated is only about 63.5 degrees C. To obtain these or similar results, a chip type LED 530 can be used, such as model CL-L251-MC6WW1-C from Citizen Electronics Co., Ltd. Japan. Such LEDs are a white power LED for general lighting, with a general color rendering index (CRI) of 85 Type, a 6 watt package (input power), and an Energy Star Correlated Color Temperature of about 3500 K. Performance of such an LED can be characterized as follows:

TABLE 1

Absolute Maximum Rating
(1) Absolute Maximum Rating

| Parameter | Symbol | Rating Value | Unit | |
|---|---|---|---|---|
| Power Dissipation | $P_D$ | 16.6 | W | |
| Forward Current | $I_F$ | 1,440 | mA | |
| Forward Pulse Current | $I_{FP}$ | 1,500 | mA | *1 |
| Reverse Current | $I_R$ | 1 | mA | |
| Operating Temperature | $T_{OP}$ | −30~+85 | C | |
| Storage Temperature | $T_{SF}$ | −40~+100 | C | |
| Junction Temperature | $Tj_{Max}$ | 150 | C | *2 |

*1 Forward Current: Duty<=1/10, Pulse Width<=10 msec
*2 D.C. Current: Tj = Tc + Rj-c × $P_D$
Pulse Current: Tj = Tc + Rj-c × Pw(Power Dissipation/One-Pulse) × Duty

TABLE 2

Electro-Optical Characteristics
(2) Electro-optical Characteristics
(Tc = 25 C.)

| Parameter | Symbol | Condition | Min. | Typ. | Max. | Unit |
|---|---|---|---|---|---|---|
| Forward Voltage | $V_F$ | $I_P$ = 720 mA | 8.75 | 9.30 | 10.5 | V |
| Luminous Flux | Φv | $I_P$ = 720 mA | 387 | 455 | — | lm |
| General Color Rendering Index | Ra | $I_P$ = 720 mA | — | 85 | — | — |
| Thermal Resistance | Rj-c | Junction-case | — | 4.0 | — | C/W |

Preferred characteristics for the candle light embodiments according to the invention can include a brightness of 455 lm, a color temperature of 3500K, a CRI of 85, and light distribution (otherwise referred to as viewing angle) of about 300 degrees. Preferred thermal data can include a maximum temperature increase of about 37.5 degrees C., a thermal resistance of about 7.8 degrees C./W, and a thermal power of about 4.8 watts (6 W at 80%). Preferred light fixture data can include a power source effective of greater than or equal to 75%, a lens effective of greater than or equal to 85%, and/or a fixture effective of greater than or equal to 63%.

Figures 6A, 6B:
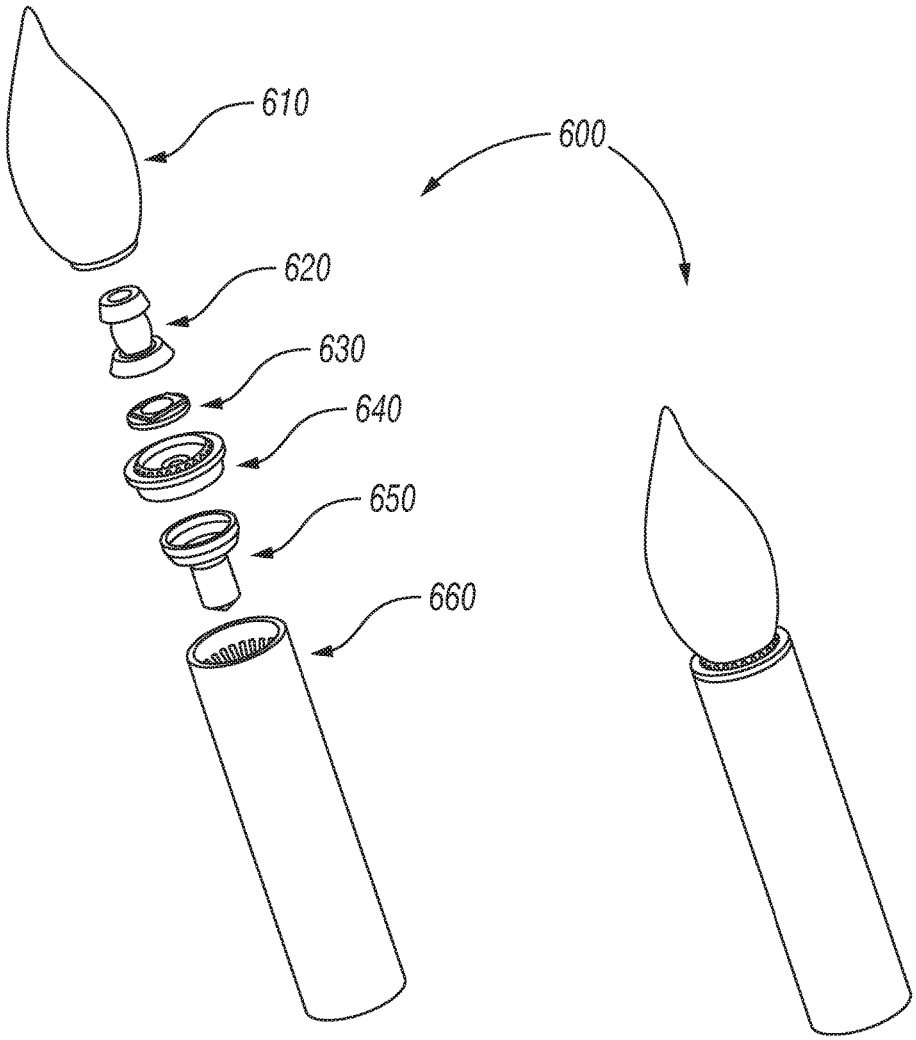
FIGS. 6A and 6B are respectively schematic diagrams of a disassembled and assembled LED candle light assembly of the invention.

FIGS. 6A-B are respectively schematic diagrams of a disassembled and assembled LED candle light assembly 600 of the invention. As shown, generally the candle light 600 can comprise a bulb 610, a lens 620, and LED 630, a connector 640, a lamp cap 650, and a radiator 660. For the bulb 610 (otherwise referred to as a lamp or globe), any bulb commonly known in the industry and commercially available in existing decorative light bulbs can be used. The bulb itself generally resembles the shape of a candle flame and can be transparent or semi-transparent, such as frosted. Bulbs with other shapes may also be used in embodiments of the present invention and according to a desired lighting effect. Any material that allows for the transmission of light through it can be used, including any glass or plastic. Preferable materials include polyvinylchloride (PVC). The candle bulb of the present invention has a hollow interior and an opening at one longitudinal end.

In certain embodiments, the lens 620 is operably configured to fit into the opening at the longitudinal end of the candle bulb and to rest on or around the LED 630. The lens 620 of the present invention may be made of any suitable material used for lenses. In certain preferred embodiments the lens may be made of PMMA (polymethyl methacrylate). Further preferred is a lens 620 comprised of a single material having a single refractive index. The lens of the present invention may have any suitable shape and may be translucent. In preferred embodiments of the present invention, the light emitted from the candle light assembly may resemble traditional incandescent candle light.

Continuing to refer to FIGS. 6A-B, the LED light source 630 of the present invention may take the form of any variety of LEDs of various wattage and/or light output color. In certain embodiments of the present invention, the LED light source may comprise a high-intensity LED, a medium-intensity LED, a low-intensity LED and any combination thereof. In preferred embodiments, the light assembly may have an LED light source emission of white or warm white. One of ordinary skill in the art, with the benefit of this disclosure, would know the appropriate LED light source to use for a particular application.

Referring again to FIG. 6A, the connector 640 may be used to connect and secure the lens and LED light source within the bulb. The connector 640 also is secured to the lamp cap, which provides for an electrical connection of the LED to a power source and for containment of the drive circuit for the LED 630. In certain embodiments of the present invention, the connector 640 may be used to pull heat away from the candle bulb to the heat sink 660. The connector 640 further may have through holes disposed in and through its upper surface around its circumference in order to release heat, thereby improving the heat dissipation of the candle light LED assembly. The connector can be any material suitable for joining the upper and lower components of the candle light as well as for dissipating heat given off from the LED light source. The present invention may comprise a lamp cap 650 chosen from a plurality of different base styles. As shown in the Figures, the candle bulb base may be contained in the interior hollow portion of the heat sink 660 when assembled. To this end, the heat sink 660 may comprise an internal compartment or housing capable of fitting the candle bulb base (otherwise referred to as a lamp cap). The connector 640 is secured to the heat sink 660 using friction, adhesive, notching, threading or any other suitable method of securing. The bulb base in certain embodiments fits loosely within the heat sink 660 and does not contact the walls of the heat sink 660. The heat sink may have an elongated shaft that may resemble a candlestick. In some embodiments, the heat sink may be configured to resemble dripping wax. In preferred embodiments, the heat sink may be hollow along its length, or a portion thereof.

Figure 7A:
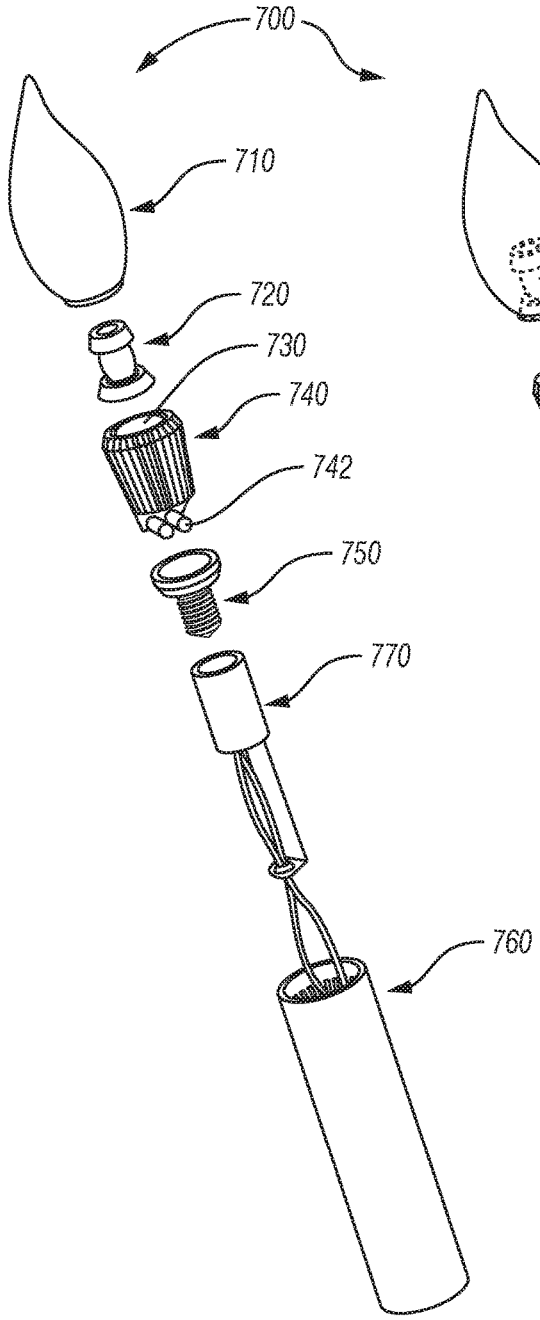
FIGS. 7A and 7B are photos of disassembled and partially assembled LED candle lights according to embodiments of the invention.
Figure 7B:
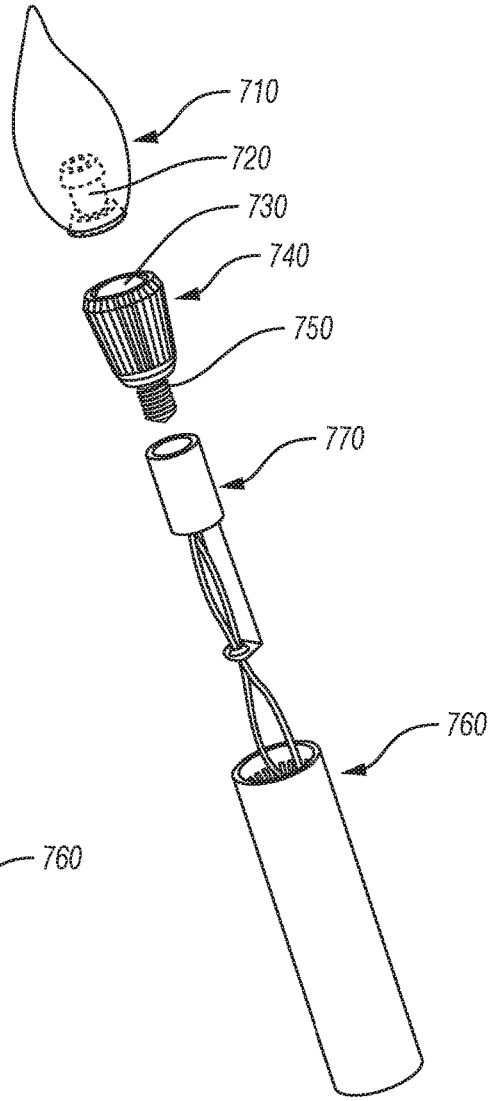

FIGS. 7A and 7B are photos of disassembled and partially assembled LED candle lights 700 according to embodiments of the invention. In these embodiments, bulb 710 is translucent, made of glass, and is shaped like a candle flame. Housed within the bulb 710 is lens 720. In this embodiment, the bulb 710 comprises structure for stabilizing the lens 720 within the bulb in a desired position and for preventing the lens 720 from coming dislodged once the system is assembled. The bulb 710 further comprises a threaded opening around the interior circumference of its base for securing the bulb 710 to the connector 740. The base of bulb 710 in this embodiment is metal. The lens 720 is disposed over or around LED 730 in a manner to provide the desired light viewing angle. The lens 720 rests within the connector 740 such that connector 740, which is also threaded, can be joined with the base of bulb 710. The connector 740, as shown, can comprise heat sink capabilities and as such can be comprised of a metal or ceramic material and optionally comprise ribs or fins for increasing the overall surface area of the connector 740 to provide for maximum heat sink efficiency. Connector 740 houses drive circuit 742 for the LED 730 and is encompassed by lamp cap 750. Lamp cap or bulb base 750 is operably configured for complementing socket 770 for insertion into the socket, which provides for electrical connection of the LED to a power source. Once assembled, socket 770 is disposed entirely within the shaft 760 and connector 740 is secured within the shaft by way of a threaded section disposed around the exterior circumference of the connector. The shaft 760 can also be operably configured to provide heat sink capabilities for the system.

Figure 8A:
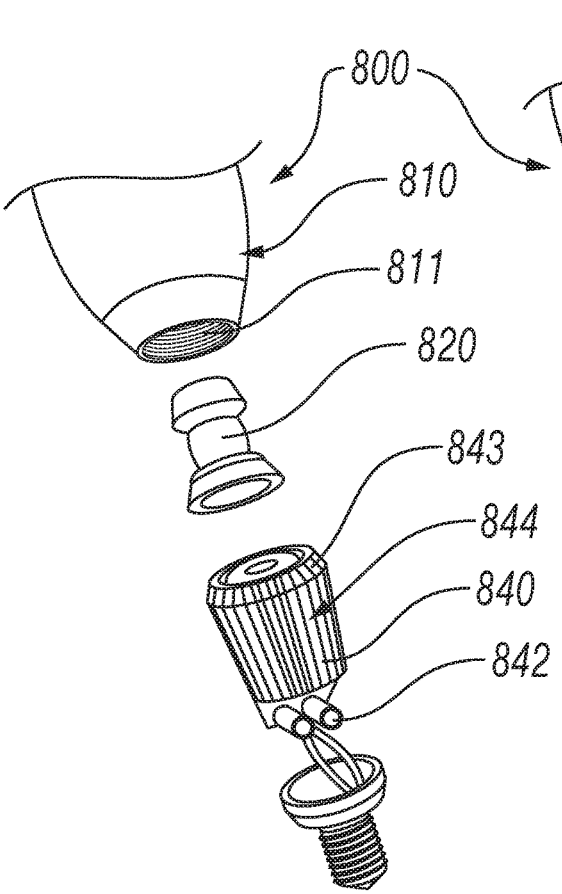
FIGS. 8A and 8B are photos of disassembled and partially assembled LED candle lights according to embodiments of the invention, showing the upper portion of the light.
Figure 8B:
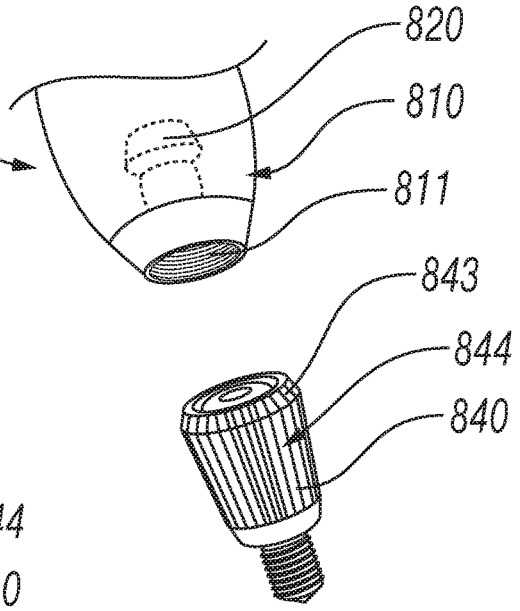

FIGS. 8A and 8B are photos of disassembled and partially assembled LED candle lights according to embodiments of the invention, showing the upper portion of the light 800. As shown, a threaded section 811 is provided along the interior circumference of bulb 810 around the opening at its base. This threaded portion of the bulb is operably configured to mate with the threaded section 843 of connector 840 and when mated to provide a secure placement of lens 820 within the bulb 810. Likewise, threaded portion 844 of connector 840 is adapted to mate with complementary threads on the interior of the shaft 860 (not shown).

Figure 9:
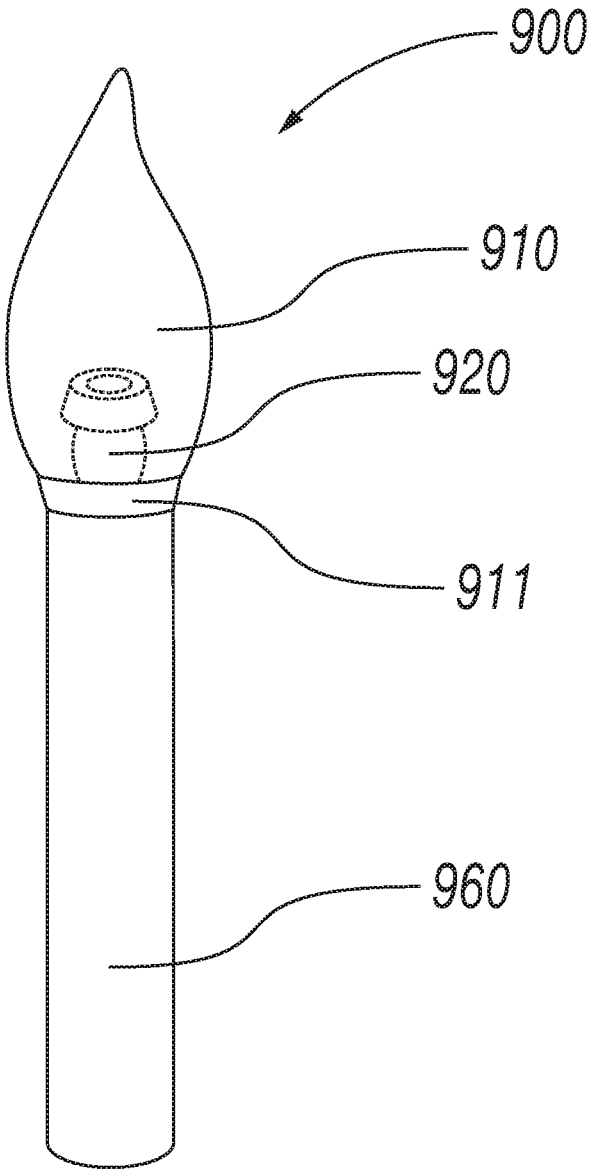
FIG. 9 is a photo of a candle light according to the invention.

FIG. 9 is a photo of a candle light 900 according to the invention. The system shown in this embodiment is fully assembled and provides for a streamlined appearance. Candle light 900 comprises a bulb 910, which houses lens 920 for distributing light from an LED in a desired manner through bulb 910. At the base of the bulb 910 is a metal collar 911 with internal threaded rings for securing the bulb 910 to the connector (not shown). The connector is then secured to the candle stick shaped shaft 960 by way of complementary threaded portions as well.

Figures 10A, 10B:
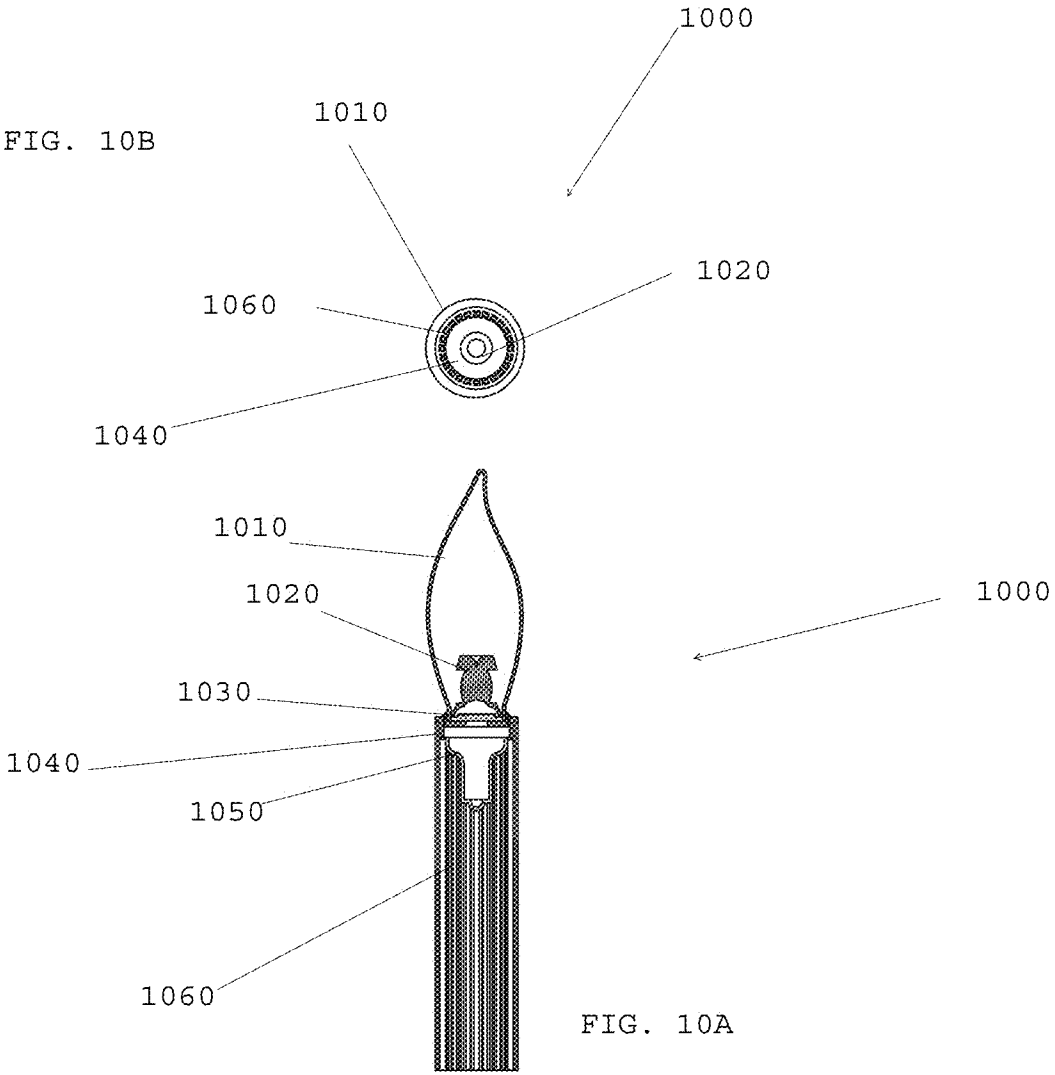
FIGS. 10A and 10B are schematic diagrams showing respectively a cross-sectional view of the candle light and a top perspective view of the heat sink.

FIGS. 10A and 10B are schematic diagrams showing respectively a cross-sectional view of the candle light 1000 and a top perspective view of the heat sink or shaft. As shown in FIG. 10A, a candle light assembly is provided which comprises a bulb 1010, a lens 1020, and LED light source 1030, a connector 1040, a lamp cap 1050, and heat sink 1060. This cross-sectional view shows how the components operate together to provide a lighting system. More particularly, the lens 1020 is housed completely with bulb 1010 and is fixed in place. LED 1030 is disposed below the lens 1020 and the lens 1020 is disposed around the LED 1030 so as to allow for the passage of light from the LED into the lens at a desired angle. The LED 1030 is disposed in contact with connector 1040 to provides for the dissipation of heat from the LED into the connector. Connector 1040 comprises means for joining the connector with the bulb, for joining the connector with the lamp cap, and for joining the connector with the shaft/heat sink 1060. Thus, the connector 1040, with three separate and distinct means for securing the upper and lower components of the lighting system in place, is responsible for providing the streamlined profile of the candle light according to the invention. The connector is multi-functional in that it can also be configured for providing heat sink capabilities and/or for assisting with the transfer of heat from the LED to the shaft 1060. As shown in FIG. 10B, a streamlined profile for the candle light is made possible by the configuration of the connector.

Figure 11:
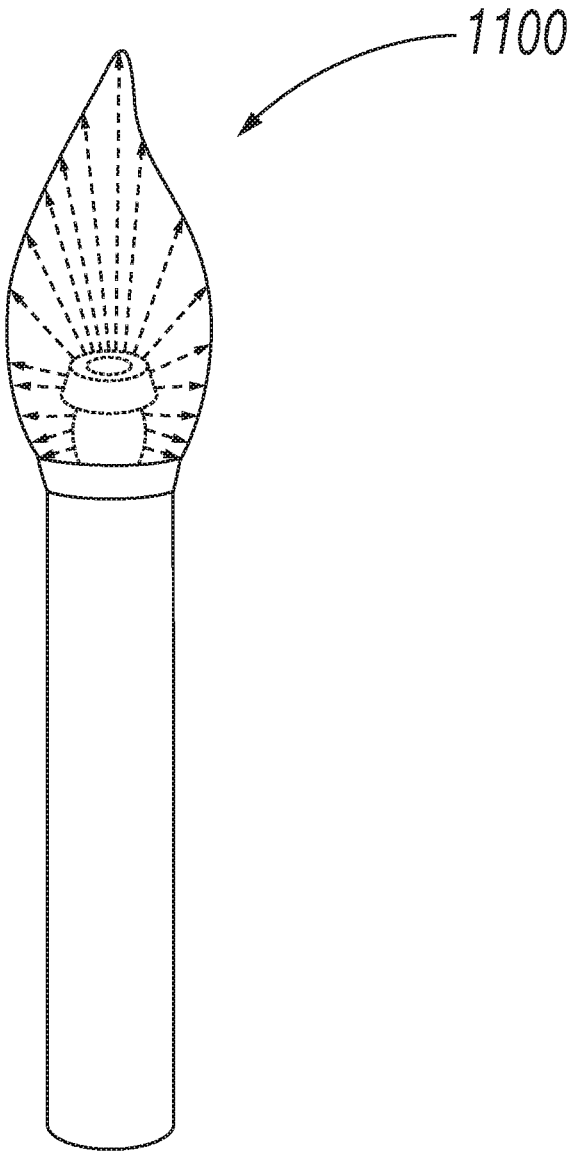

FIG. 11 is a photo of a candle light 1100 according to the invention, which has the LED illuminated. As shown, light from the LED is passed through the lens and emitted through the glass bulb to provide a viewing angle of about 300 degrees.

Figure 12:
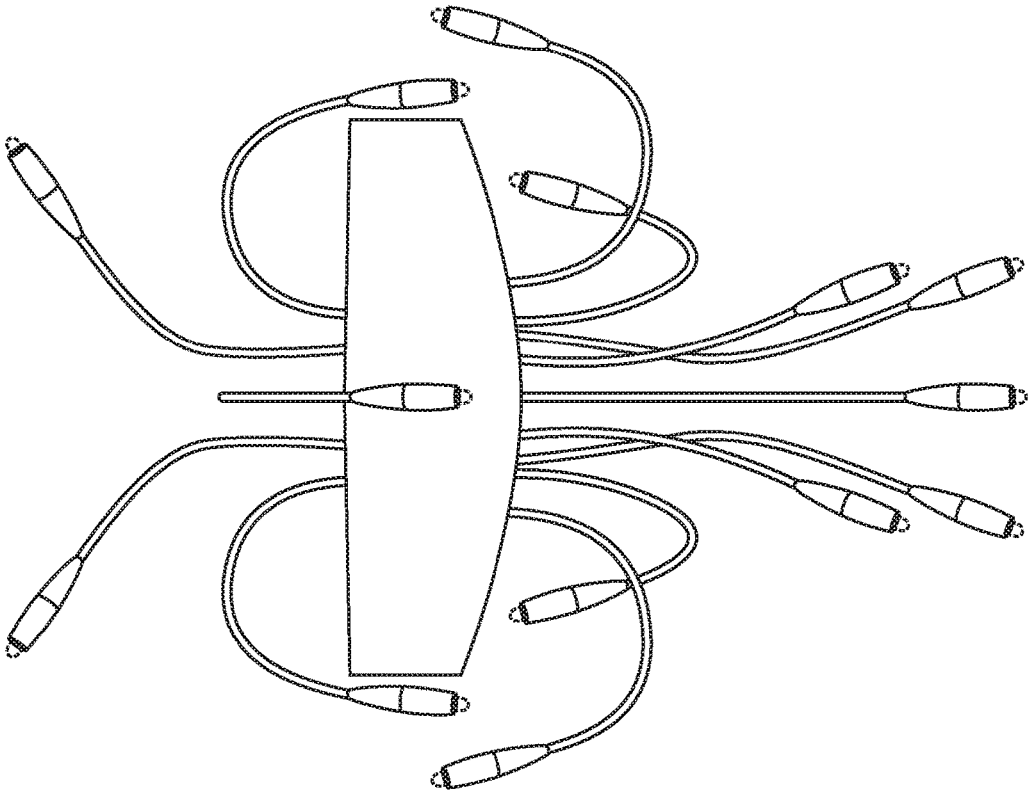
FIG. 12 is a photo of an embodiment of a candle light according to the invention.

FIG. 12 is a photo of another embodiment of the lighting systems of the invention. As shown, the candle light system comprises a plurality of candle lights 1200, each having a globe 1210 (which can be a globe, a bulb, or lens or any combination thereof), an LED light source 1230 which provides light to the globe 1210 during use (LED itself is not visible), a connector 1240, and LED heat sink 1260. The candle lights 1200 are each disposed on the end of a flexible and positionable support. Means for delivering electrical energy from a power source to the LEDs, such as insulated wire leads, can be disposed within the flexible supports. Preferably, the wire leads terminate in a socket portion of the candle lights 1200. Plugged into the socket portion is the heat sink 1260 module, which can comprise a heat sink for dissipating heat from the lighting system, the drive mechanism for powering the LED, and a PCB board on which one or more LED is mounted in operable communication with the remaining components. In this embodiment, the specific configuration of the globe, bulb, and lens is not critical, however, the embodiments of such as disclosed in this specification can be used.

Figure 13A:
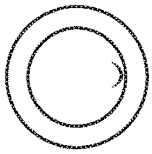
FIGS. 13A-C are schematic diagrams showing respectively a front elevation view, a side cross-sectional view, and a rear elevation view of a candle light of the invention.
Figure 13B:
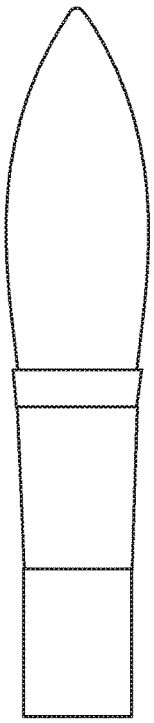
Figure 13C:
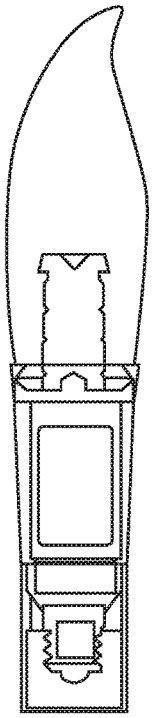
Figure 13D:
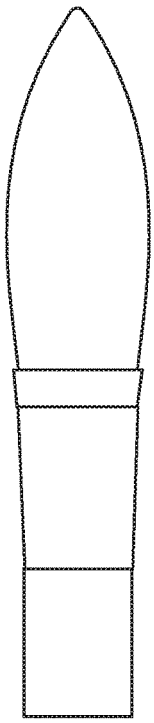
FIGS. 13D-E are schematic drawings providing a top planar view and a bottom planar view of the embodiment shown.
Figure 13E:
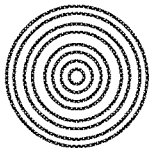

FIGS. 13A-C are schematic diagrams showing respectively a front elevation view, a side cross-sectional view, and a rear elevation view of a candle light embodiment according to the invention. FIGS. 13D-E are schematic drawings providing a top planar view and a bottom planar view of the embodiment shown in FIGS. 13A-C. This is a low voltage candle light. As shown in FIGS. 13A and 13C, a candle light assembly is provided which comprises a bulb, a bulb connector, an intermediate housing, and a shaft or heat sink as the exterior components of the lighting system. As illustrated in the cross-sectional view, FIG. 13B, it can be seen how these exterior components house or contain and operate together with the interior components of the lighting system to provide a lighting system according to the invention. More particularly, the lens can be housed completely within the bulb and fixed in place by securing the bulb and/or bulb connector to the lighting system. Optionally, embodiments may comprise no bulb. A means for connection of the bulb into the lighting system can be by way of threading on the bulb which can interact with corresponding threading of the connector/intermediate housing. A bulb connector (as shown) can be included which is fixed to the bulb and provides the threading means for connecting the bulb to the connector/intermediate housing. An LED is disposed below the lens and the lens is operably configured around the LED so as to allow for the passage of light from the LED into the lens and out of the lens at a desired viewing angle. In embodiments, the lens may or may not come into direct contact with the LED. The LED is disposed on and operably connected to a printed circuit board (PCB) and the PCB is in contact with connector/intermediate housing. In preferred embodiments, the LED is disposed on a planar PCB and the PCB is disposed on a planar surface of the connector/intermediate housing.

Located within the connector/intermediate housing is a converter for converting from a higher power supply to a lower voltage, such as converting down to 110 volts. The converter is operably connected to the PCB and the lamp cap base. Connector/intermediate housing comprises means for joining the connector/intermediate housing with the bulb or bulb connector, for joining the intermediate housing with the lamp cap, and for joining the intermediate housing with the shaft/heat sink. Thus, the intermediate housing, with three separate and distinct means for securing the upper and lower components of the lighting system in place, is responsible for providing the streamlined profile of the candle light according to the invention. The connector is multi-functional in that it functions as a connector for securing the lighting system as a whole together as well as provides a housing for the converter, when present. In embodiments, the connector/intermediate housing can also be configured for providing heat sink capabilities and/or for assisting with the transfer of heat from the LED to the shaft.

Figure 14A:
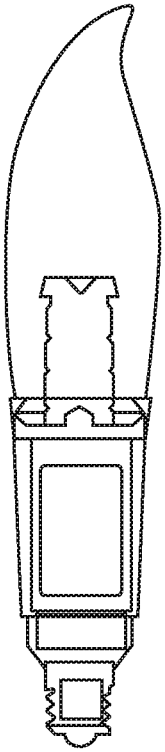
FIGS. 14A-B are schematic diagrams showing a side cross-sectional view of the candle light and the heat sink.
Figure 14B:
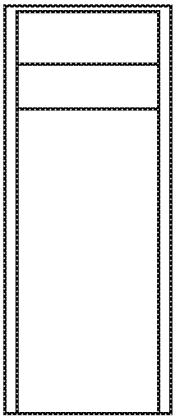

FIGS. 14A-B are schematic diagrams showing respectively cross-sectional views of the candle light and the candle light shaft or heat sink when they are detached. As shown in FIG. 14B, the shaft or heat sink can be connected to the lighting system to cover the lamp cap using threading disposed on the interior surface of the heat sink shaft. This threading is operably configured to correspond with and be secured to cooperative threading disposed on the exterior surface of the connector/intermediate housing. The shaft and intermediate housing may also be held together using friction, adhesive, notching, or any other suitable method of securing, although threading is preferred for quick release of the components.

Figure 15:
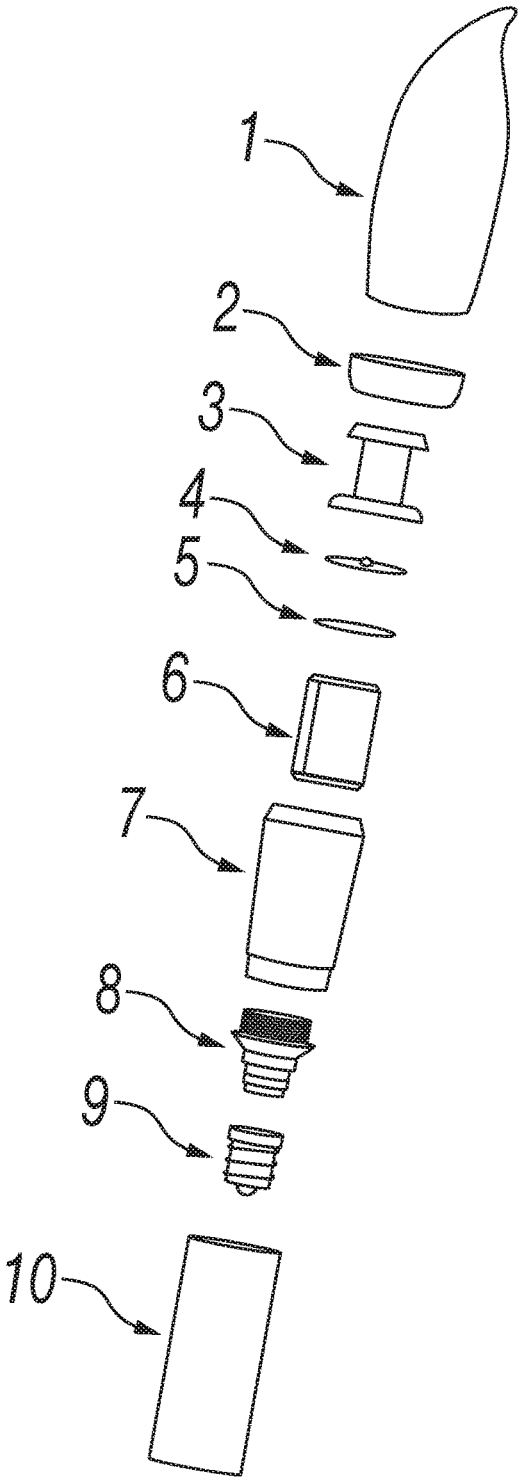
FIG. 15 is a schematic diagram of a disassembled candle light assembly.

FIG. 15 is a schematic diagram providing an exploded view of a disassembled candle light embodiment of the invention. In this embodiment, the bulb is translucent, made of glass, and is shaped like a candle flame. The bulb in all embodiments described in this specification is optional. Housed within the bulb is the lens. In this embodiment, the bulb or bulb connector comprises structure for stabilizing the lens within the bulb in a desired position and for preventing the lens from coming dislodged once the system is assembled. The bulb can further comprise a threaded opening around the exterior circumference of its base for securing the bulb to the bulb connector which has a corresponding threaded interior circumference. Alternatively, the bulb can be fixed to the bulb connector using an adhesive. The bulb connector in this embodiment is metal but can be made of a variety of materials, including plastic or glass. The lens is disposed over and/or around the LED in a manner to provide the desired light viewing angle. The lens rests within and is secured within the lighting system by the bulb connector and/or the base of the bulb, for example by a rim incorporated into the bulb connector which interacts with a planar surface of the base of the lens to retain the lens in place. The LED is disposed on and operably connected with a PCB. The PCB is also operably connected to the converter for providing power to the LED. The LED, PCB, and converter are all housed and kept in place within the intermediate housing, with the LED at or near the top of the opening of the intermediate housing and in some cases extending into the bulb.

The intermediate housing comprises threading on each end, by which it may be secured to the bulb or bulb connector at one end and to the lamp cap at the opposing end. The lamp cap in this embodiment is of the E126 type, however, any type of lamp cap can be used for a desired application. The lamp cap is operably configured for electrical connection with the converter and a power source for providing a source of electricity to the converter and other LED drive circuitry for powering the LED. In this embodiment, the lamp cap comprises a lamp camp connector and a base, where the lamp cap connector secures to the base of the intermediate housing and is connected to the lamp cap base. Once assembled, the lamp cap is disposed entirely within the shaft or heat sink. The shaft or heat sink can provide heat sink capabilities for the system in order draw heat away from the candle.

Figure 16A:
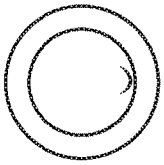
FIGS. 16A-C are schematic diagrams showing respectively a front cross-sectional view, a side cross-sectional view, and a rear cross-sectional view of a candle light embodiment according to the invention.
Figure 16B:
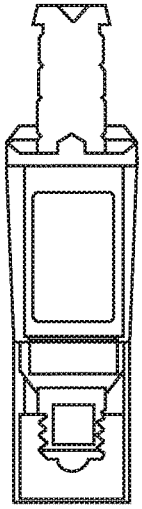
Figure 16C:
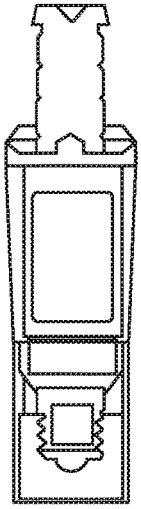
Figure 16D:
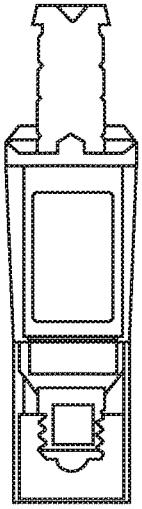
FIGS. 16D-E are schematic drawings providing a top planar view and a bottom planar view of the embodiment shown.
Figure 16E:
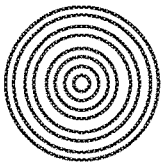

FIGS. 16A-C are schematic diagrams showing cross-sectional views respectively of a front, side, and rear elevation view of a candle light embodiment of the invention. FIGS. 16D-E are schematic diagrams respectively of a top and bottom planar view of the candle light of FIGS. 16A-C. This is a low voltage candle light. As shown in FIGS. 16A-C, there is no bulb in this embodiment and the lens is exposed. Additionally, there is no shaft/heat sink. The lens is secured to the candle light by a lens connector (also referred to as the bulb connector in FIG. 15, but here there is no bulb), which secures a portion of the base of the lens within the lighting system when the connector is secured to the intermediate housing. One way of accomplishing securing of the lens within the system is to have the connector configured with a lip around its upper circumference. When the connector is secured to the intermediate housing, the base of the lens is prevented from being removed from the lens connector by engaging with the rim of the lens connector. The LED is disposed below the lens and the lens is disposed around the LED so as to allow for the passage of light from the LED into the lens at a desired angle. The LED is disposed on and operably connected to the PCB and the PCB is in contact with the connector/intermediate housing. Located within the connector/intermediate housing is the converter which is operably connected to the PCB and the lamp cap. Connector/intermediate housing comprises means for joining the connector/intermediate housing with the lens connector, and for joining the intermediate housing with the lamp cap. Thus, the intermediate housing, with distinct means for securing the upper and lower components of the lighting system in place, is responsible for providing the streamlined profile of the candle light according to the invention. In embodiments, the intermediate housing is multi-functional in that it can also be configured for providing heat sink capabilities and/or for assisting with the transfer of heat from the LED and away from the lighting system. It is noted that in this embodiment there is no additional shaft/heat sink for housing the lower portions of the lighting system such as the lamp cap. In all embodiments of the invention such an additional shaft/heat sink is an optional component.

Figure 17:
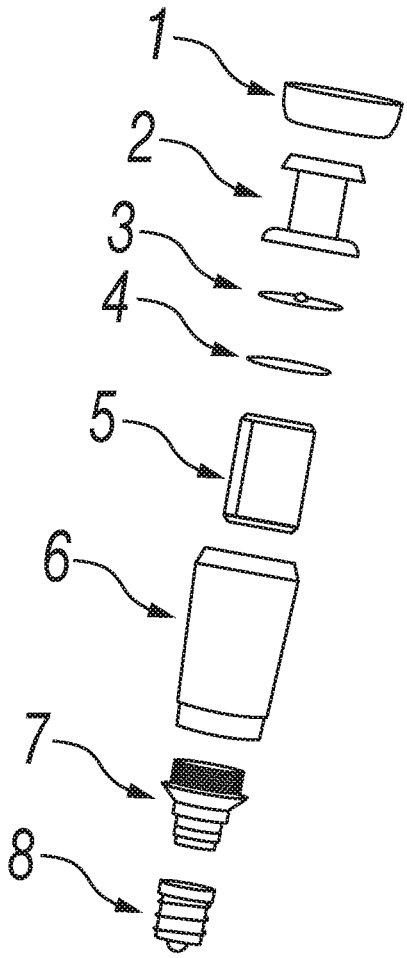
FIG. 17 is a schematic diagram of a disassembled candle light assembly.

FIG. 17 is a schematic diagram of the disassembled candle light embodiment shown in FIGS. 16A-E. In this embodiment, the lens is exposed and is secured in place with the lens connector (the lens connector and bulb connector are one in the same, but this component is referred to as the lens connector here because there is no bulb present). The lens is disposed over or around the LED in a manner to provide the desired light viewing angle. The lens rests within the connector such that the connector, which is threaded, can be joined with the intermediate housing and provide securing means for retaining the lens in place, such as a lip that engages with the planar base of the lens. The LED is disposed on and operably connected with the PCB. The PCB is operably connected with the converter to provide power to the LED. The LED, PCB, and converter are all housed and kept in place within the intermediate housing. The intermediate housing comprises threading on each end, one so that it may secure to the bulb connector and the other end to the lamp cap. The lamp cap comprises a lamp camp connector and a lamp cap base. The lamp cap connector at one end secures to the lower portion of the intermediate housing and at the other end it is connected to the lamp cap base. The lamp cap base provides an E126 type connection in this embodiment. A heat sink encompassing the lamp cap base is optional and in this embodiment is omitted.

In summary, the low voltage candelabra based lighting system can be configured as outlined in the two embodiments provided in FIGS. 13-17 by having a bulb and candle like shaft base, or no bulb and no candle like shaft base, or no bulb with a candle like shaft base, or with a bulb and no candle like base. Lighting systems of the invention can comprise a plurality of lights within the system as shown in FIG. 12 and can comprise any type or any combination of types of lights described in this specification. For example, a lighting system may have a plurality of lights comprising no bulb and no candle like shaft alone or in combination with a plurality of lights comprising a bulb and a candle like shaft. Likewise, a lighting system of the invention could comprise a plurality of lights comprising no bulb but having a candle like shaft alone or in combination with a plurality of lights comprising a bulb but no candle like shaft.

Figure 18A:
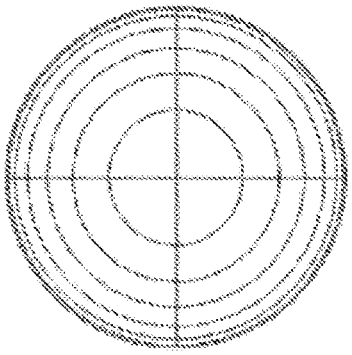
FIGS. 18A-C are schematic diagrams showing respectively a front elevation view, a side elevation view with a cross-sectional view of the bulb, and a rear elevation view of a candle light embodiment according to the invention.
Figure 18B:
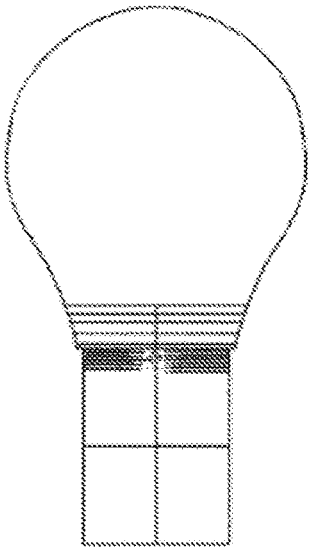
Figure 18C:
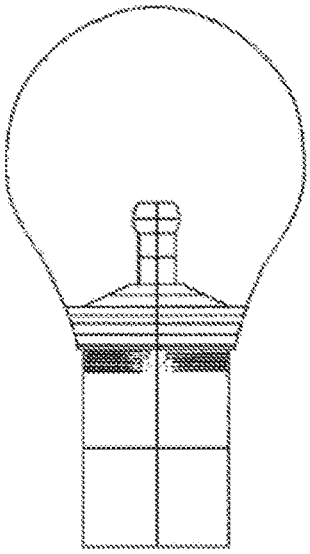
Figure 18D:
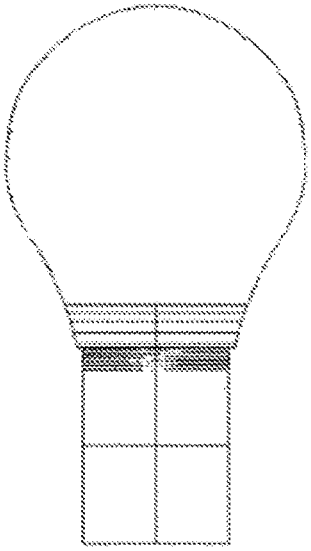
FIGS. 18D-E are schematic drawings providing a top planar view and a bottom planar view of the embodiment shown.
Figure 18E:
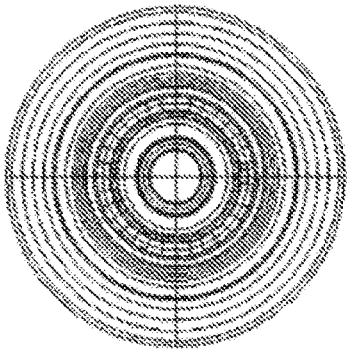

FIGS. 18A-E are schematic diagrams showing respectively a front elevation view, a side cross-sectional view, and a rear elevation view of a light embodiment according to the invention. FIGS. 18D-E are schematic drawings providing a top planar view and a bottom planar view of the embodiment shown in FIGS. 18A-C, which resemble a traditional light-bulb. This is a low voltage candle light. As shown in FIG. 18A, a light assembly is provided which comprises a bulb, a bulb or lens connector, an intermediate housing, and a shaft or heat sink as the external components of the bulb. The cross-sectional view, FIG. 18B shows how the external and internal components operate together to provide a lighting system.

Figure 19:
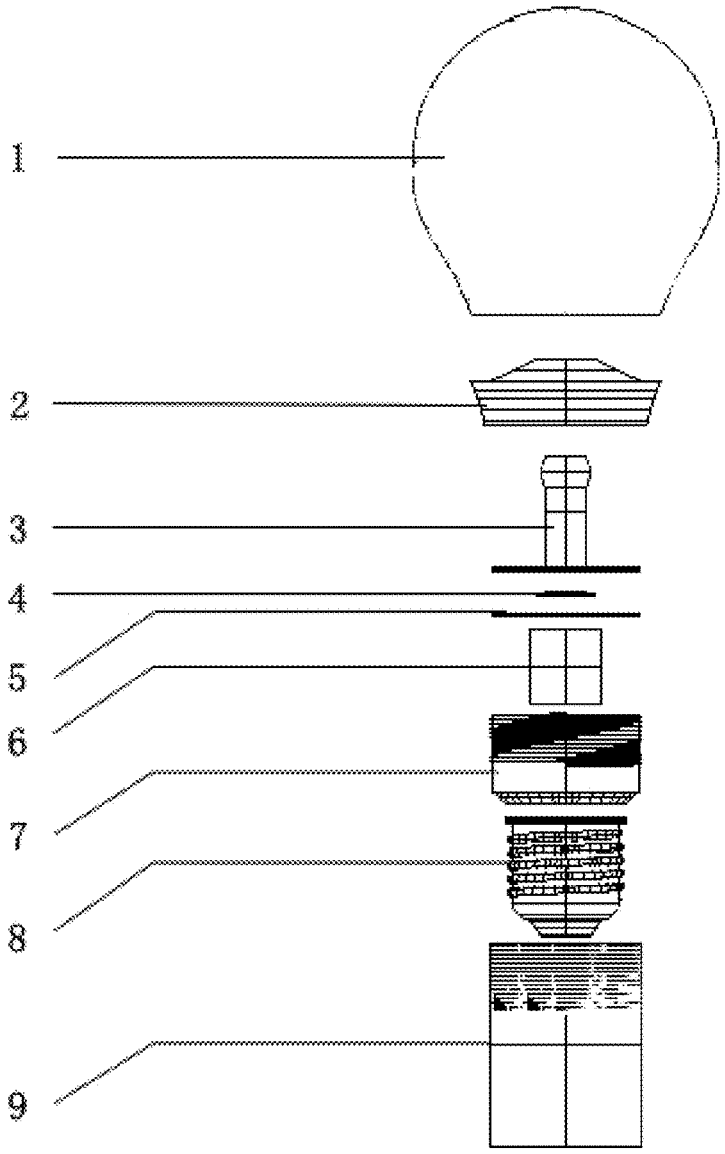
FIG. 19 is a schematic diagram of a disassembled candle light assembly.

FIG. 19 is a schematic diagram of a disassembled bulb as shown in FIGS. 18A-E. In this embodiment, the bulb is made of glass, is optionally translucent, and is shaped like a traditional bulb. Housed within the bulb is the lens. In this embodiment, the lighting system comprises structure for stabilizing the lens within the bulb in a desired position and for preventing the lens from coming dislodged once the system is assembled, which structure as shown is a bulb/lens connector. The bulb can comprise a threaded opening around the interior or exterior circumference of its base for securing the bulb to corresponding threading of the bulb/lens connector, or the bulb and bulb/lens connector can be fused together with adhesive or by other means. The bulb/lens connector in this embodiment is metal but can be made of a variety of materials. The bulb/lens connector provides means for retaining the lens in the lighting system by retaining the base of the lens while securing to the intermediate housing or to the shaft/heat sink if present. The lens is disposed over or around the LED in a manner to provide the desired light viewing angle and emerges from an opening in the bulb/lens connector to emit light from the LED into the bulb. The LED is disposed on and operably connected with the PCB. The PCB is also operably connected to the converter for providing electrical power to the LED. The LED, PCB, and converter are all housed and kept in place within the intermediate housing. The intermediate housing comprises threading on each end, one end so that it may secure to the bulb/lens connector and the other end to the lamp cap. In embodiments where the bulb/lens connector is secured to the shaft, the intermediate housing may connect with the interior surface of the shaft/heat sink, usually by way of cooperating threads on the external surface of the intermediate housing and the interior surface of the shaft/heat sink. In such embodiments, once assembled, the intermediate housing, including the LED, PCB and converter, and the lamp cap are all disposed entirely within the shaft or heat sink. The bulb/lens connector comprises threading on its interior surface to cooperate with and secure to threading disposed on the interior surface of the shaft. The shaft/heat sink can provide heat sink capabilities for the system in order draw heat away from the light assembly. As with all embodiments of the invention, the heat sink/shaft is optional.

Figure 20A:
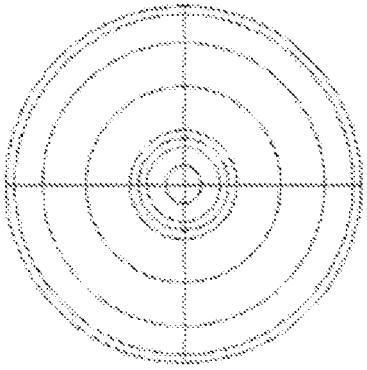
FIGS. 20A-C are schematic diagrams showing respectively a front elevation view, a side elevation view, and a rear elevation view of a candle light of the invention.
Figure 20B:
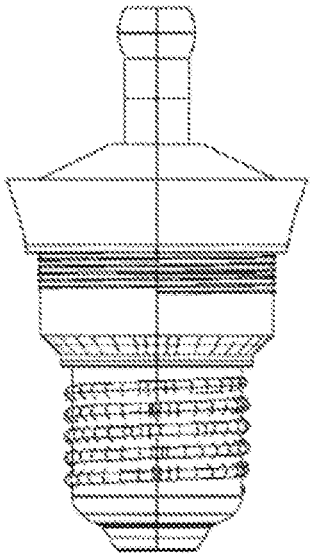
Figure 20C:
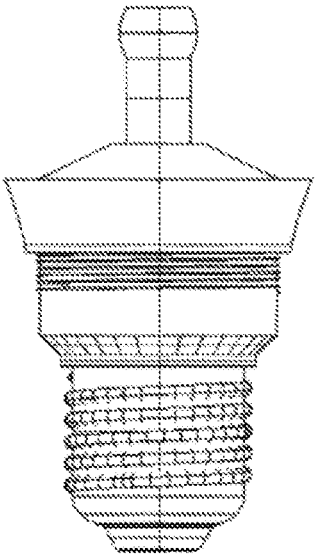
Figure 20D:
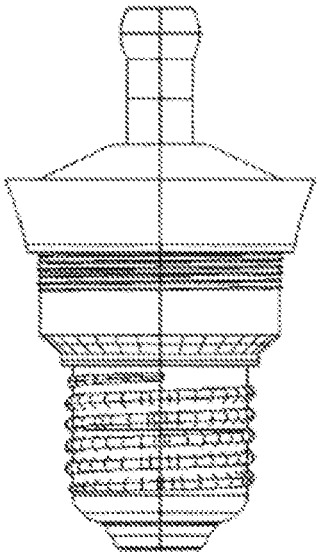
FIGS. 20D-E are schematic drawings providing a top planar view and a bottom planar view of the embodiment shown.
Figure 20E:
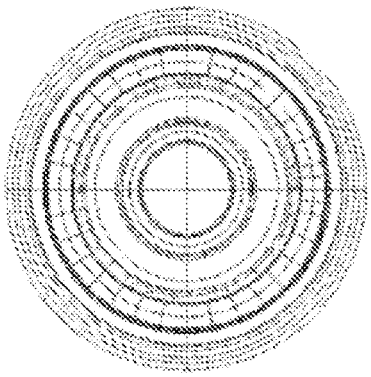

FIGS. 20A-C are schematic diagrams showing a front, side, and rear elevation view of an embodiment of a light according to the invention. FIGS. 20D-E are respectively schematic diagrams showing top and bottom planar views of the light of FIGS. 20A-C. This is a low voltage embodiment of the invention. FIG. 20A shows how the components operate together to provide a lighting system. In this particular embodiment, the lens is exposed and is fixed in place by the bulb/lens securing means. The lens securing means connects to the intermediate housing. The intermediate housing and lens securing means together house the LED, PCB and converter for the lighting assembly. The connector/intermediate housing comprises means for joining the connector/intermediate housing with the bulb connector/lens securing means, and for joining the connector with the lamp cap/light assembly base. In this embodiment the components are joined by way of cooperating threading on each of the components, however, alternative means for securing the components together can be used, such as by using an adhesive. It is noted that a heat sink at the base of the light is an optional component as is the bulb and in this embodiment there is neither.

Figure 21:
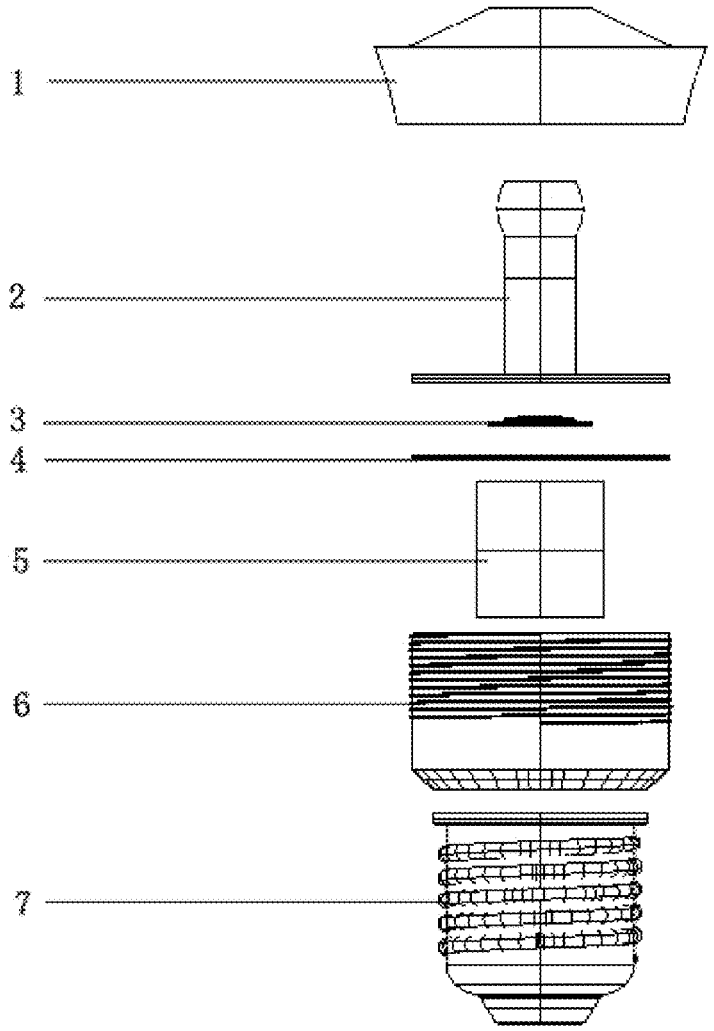
FIG. 21 is a schematic diagram of a disassembled candle light assembly.

FIG. 21 is a schematic diagram of a disassembled light of the embodiment as illustrated in FIGS. 21A-E. In this embodiment, the upwardly projecting portion of the lens is disposed in an opening of the bulb/lens connector and a base of the lens is retained in place by securing the bulb/lens connector to the remaining portions of the light. The base of the lens is disposed over or around the LED in a manner to provide the desired light viewing angle. During operation, light from the LED passes upwardly through the lens and is emitted outwardly from the lighting system at the desired viewing angle provided by the lens. The LED is disposed on and operably connected to the PCB. The PCB is also operably connected to the converter. The LED, base of the lens, PCB, and converter are all housed and kept in place within the intermediate housing and lens/bulb connector. The intermediate housing comprises threading on each end, one so that it may secure to the bulb/lens connector and the other end to the lamp cap, which in this embodiment is an E126 type lamp cap. The lamp cap is operably configured for joining with a socket, which provides for electrical connection of the LED to a power source.

In summary, the low voltage E126 type based lighting system can be configured as outlined in the two embodiments provided in FIGS. 18-20 by having a bulb and candle like shaft base, or no bulb and no candle like shaft base, or no bulb with a candle like shaft base, or with a bulb and no candle like base. Lighting systems of the invention can comprise a plurality of lights within the system as shown in FIG. 12 and can comprise any type or any combination of types of lights described in this specification. For example, a lighting system may have a plurality of lights comprising no bulb and no candle like shaft alone or in combination with a plurality of lights comprising a bulb but no candle like shaft. Likewise, a lighting system of the invention could comprise a plurality of lights comprising no bulb but having a candle like shaft alone or in combination with a plurality of lights comprising a bulb and a candle like shaft.

Figure 22A:
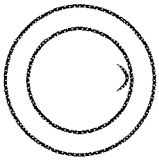
FIGS. 22A-C are schematic diagrams showing respectively a front elevation view, a side cross-sectional view, and a rear elevation view of a candle light of the invention.
Figure 22B:
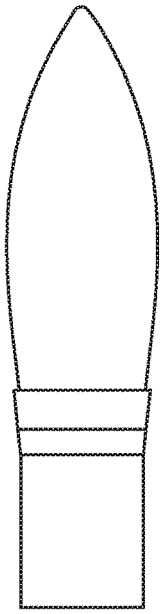
Figure 22C:
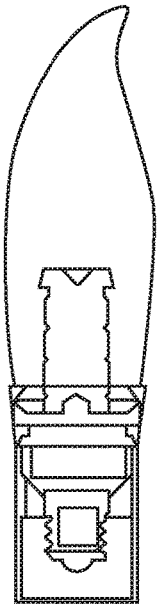
Figure 22D:
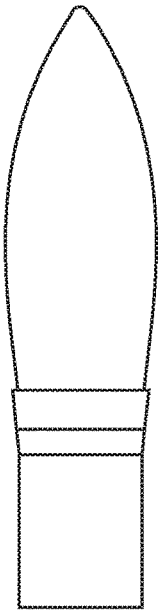
FIGS. 22D-E are schematic drawings providing a top planar view and a bottom planar view of the embodiment shown.
Figure 22E:
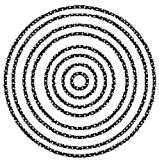

FIGS. 22A-C are schematic diagrams showing respectively a front elevation view, a side cross-sectional view, and a rear elevation view of a high voltage candle light according to embodiments of the invention. FIGS. 22D-E are schematic diagrams showing respectively a top planar view and bottom planar view of the lighting assembly embodiment of FIGS. 22A-C. This is a high voltage option for the lighting assemblies of the invention, which use 110 V.

As shown in FIG. 22A, a candle light assembly is provided which comprises a bulb, a bulb/lens connector, an intermediate housing, and a shaft or heat sink as the external components of the lighting system. The cross-sectional view, FIG. 22B, shows how the internal components operate together with the external components to provide a lighting system. More particularly, the lens is housed within the bulb and is fixed in place by the bulb resting on the base of the lens or by a rim of the bulb/lens connector resting on the base of the lens. One or more LEDs are disposed below the lens and the lens is disposed around the LED so as to allow for the passage of light from the LED into the lens at a desired viewing angle. The LED is disposed on and operably connected to a PCB and both are housed within the connector/intermediate housing and bulb/lens connector. The lens can be retained in place by the bulb/lens connector which is connected with the upper portion of the intermediate housing. The lower portion of the intermediate housing is operably connected to the lamp cap by way of internal threading on the interior surface of the intermediate housing. The intermediate housing comprises means for joining with the bulb/lens connector, for joining with the lamp cap, and for joining with the shaft/heat sink. Thus, the connector/intermediate housing, with three separate and distinct means for securing the upper and lower components of the lighting system in place, is responsible for providing the streamlined profile of the candle light according to the invention. The connector/intermediate housing in embodiments can also be configured for providing heat sink capabilities and/or for assisting with the transfer of heat from the LED to the shaft.

Figure 23A:
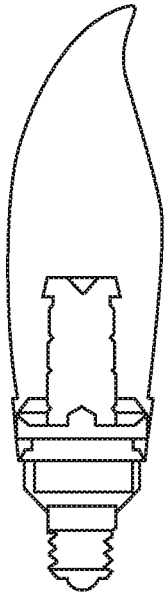
FIGS. 23A-B are schematic diagrams showing a side cross-sectional view of the candle light and the heat sink.
Figure 23B:
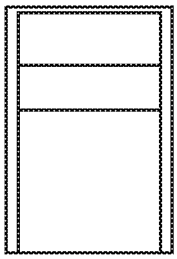

FIGS. 23A-B are schematic diagrams showing respectively cross-sectional views of a candle light and candle light shaft/heat sink when they are detached. As shown in FIG. 23B, the shaft/heat sink can be connected to the intermediate housing threading disposed on the internal surface of the shaft which cooperates with threading on the exterior surface of the intermediate housing. Alternatively, in this embodiment and any embodiment according to the invention, the shaft may also be joined to the intermediate housing by using friction, adhesive, notching, or any other suitable method of securing.

Figure 24:
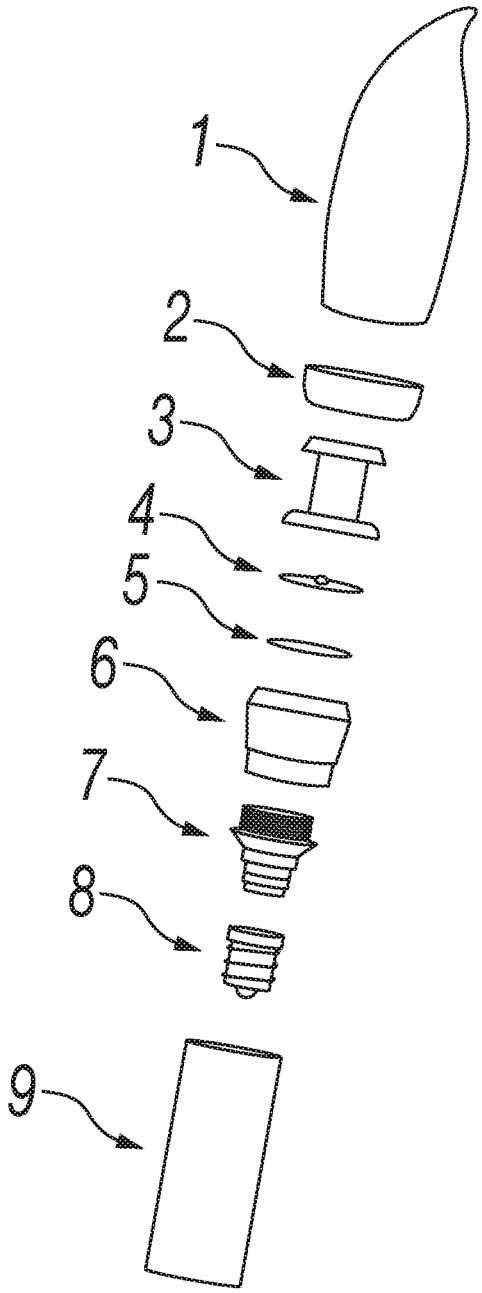
FIG. 24 is a schematic diagram of a disassembled candle light assembly.

FIG. 24 is a schematic diagram of a disassembled high voltage candle light. In this embodiment, the bulb is preferably translucent, made of glass, and is shaped like a candle flame. This is a high voltage candelabra type lighting system of the invention. Housed within the bulb is the lens. In this embodiment, the bulb and/or bulb/lens connector comprises structure for stabilizing the lens within the bulb in a desired position and for preventing the lens from coming dislodged once the system is assembled, such as a rim disposed on the lens connector or the bulb itself resting on the base of the lens and secured into the lighting system by the lens connector. The bulb can comprise a threaded opening around the circumference of its base for securing the bulb to the bulb/lens connector, or it can be joined to the bulb/lens connector using adhesive or other bonding techniques. The internal components of the lighting system can cooperate together and with the external components of the system in a similar manner as described above for the low voltage option provided in FIG. 15. In embodiments, one difference between the low and high voltage embodiments is that there is no need for a converter in the high voltage option, since the 110 voltage can be used directly by the lighting system and there is no need to convert the power to a lower voltage. Because there is no need for a converter, the overall size and length of the internal housing can be smaller in the high voltage embodiment as compared with the low voltage embodiment. This embodiment illustrates an example of a high voltage lighting assembly with a bulb but no candle type base.

Figure 25A:
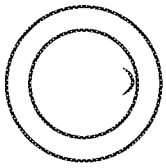
FIGS. 25A-C are schematic diagrams showing respectively a front elevation view, a side elevation view, and a rear elevation view of a candle light of the invention.
Figure 25B:
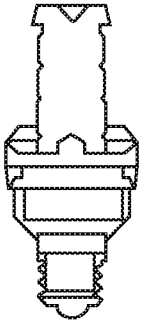
Figure 25C:
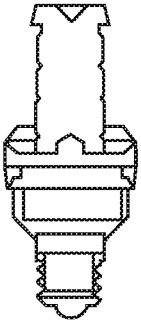
Figure 25D:
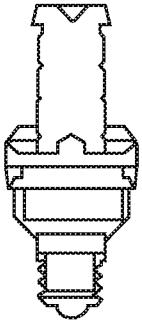
FIGS. 25D-E are schematic drawings providing a top planar view and a bottom planar view of the embodiment shown.
Figure 25E:
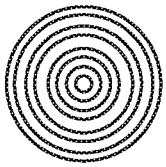

FIGS. 25A-C are schematic diagrams showing front, side, and rear cross-sectional views of a high voltage candelabra type candle light of the invention. FIGS. 25D-E are schematic diagrams illustrating a top and bottom planar view of the embodiment. This embodiment illustrates how the lighting assembly can be configured for high voltage, without a glass cover (bulb) and without a candle like base (shaft/heat sink).

FIGS. 25A-C show how the external components operate together to provide a lighting system and function in the same way as described for the low voltage embodiment provided in FIG. 16A-C.

Figure 26:
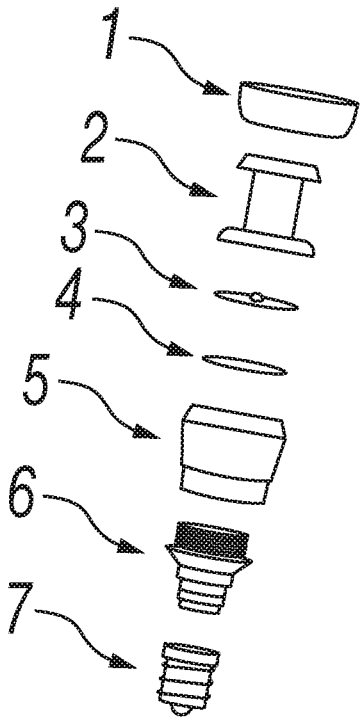
FIG. 26 is a schematic diagram of a disassembled candle light assembly.

Likewise, FIG. 26 is a schematic diagram of a disassembled high voltage candle light of the invention without a bulb and without a shaft, candle like base. The internal components of the lighting system can cooperate together and with the external components of the system in a similar manner as described for the low voltage option provided in FIG. 17. In embodiments, one difference between the low and high voltage embodiments is that there is no need for a converter in the high voltage option, since the 110 voltage can be used directly by the lighting system and there is no need to convert the power to a lower voltage. Because there is no need for a converter, the overall size and length of the internal housing can be smaller in the high voltage embodiment as compared with the low voltage embodiment. This embodiment illustrates an example of a high voltage lighting assembly with a bulb but no candle type base.

In summary, the high voltage candelabra type based lighting system can be configured as outlined in the two embodiments provided in FIGS. 22-26 by having a bulb and candle like shaft base, or no bulb and no candle like shaft base, or no bulb with a candle like shaft base, or with a bulb and no candle like base. Lighting systems of the invention can comprise a plurality of lights within the system as shown in FIG. 12 and can comprise any type or any combination of types of lights described in this specification, whether high voltage, low voltage, or a combination. For example, a lighting system may have a plurality of lights comprising a bulb and candle alone or in combination with a plurality of lights comprising a bulb but no candle like shaft.

Figure 27A:
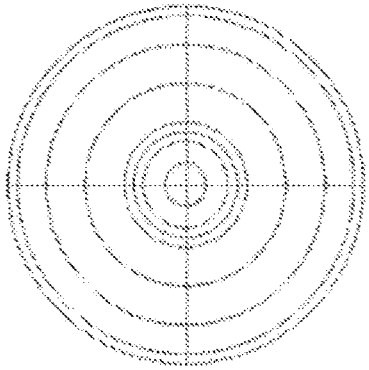
FIGS. 27A-C are schematic diagrams showing respectively a front elevation view, a side elevation view, and a rear elevation view of a candle light of the invention.
Figure 27B:
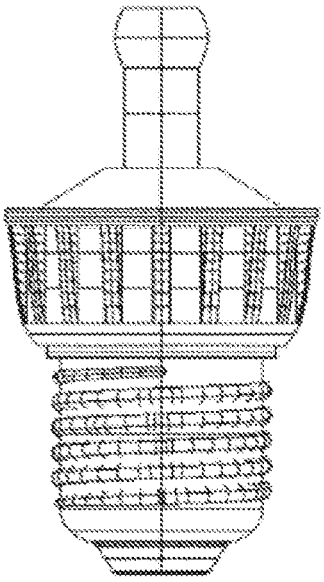
Figure 27C:
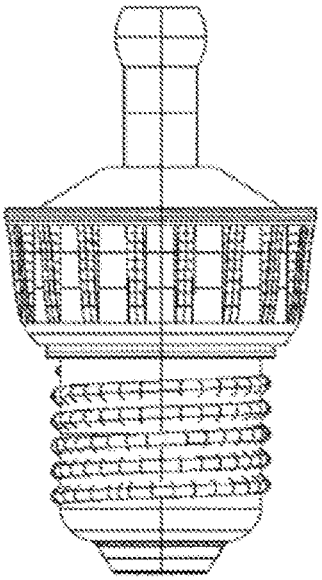
Figure 27D:
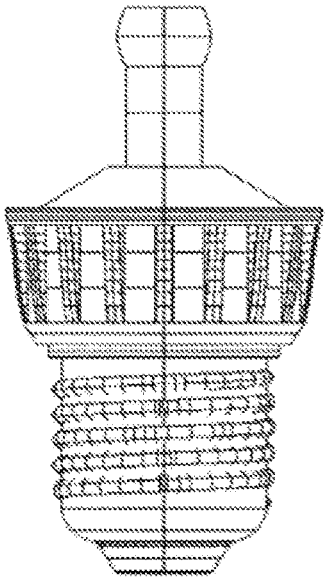
FIGS. 27D-E are schematic drawings providing a top planar view and a bottom planar view of the embodiment shown.
Figure 27E:
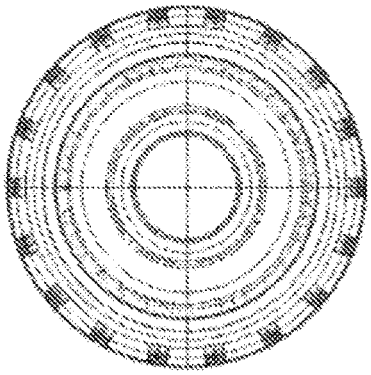

FIGS. 27A-C are schematic diagrams showing a front perspective view of a high voltage E126 type base light of the invention. FIGS. 27D-E are schematic diagrams illustrating a top and bottom planar view of the embodiment shown in FIGS. 27A-C. This is a high voltage, E126 type option, without a glass cover (bulb) and without a candle like base (shaft).

FIG. 27A shows how the external components of this embodiment operate together to provide another high voltage lighting system of the invention. In this particular embodiment, the upwardly extending portion of the lens is not encompassed by a bulb and is fixed in place by the bulb/lens connector/securing means. The lens securing means has threading on its internal surface and connects to threading disposed on an external surface of an upper portion of the intermediate housing. The lens/bulb connector can be configured to provide heat sink capabilities. As shown, ribs or fins can be disposed on the external surface of the lens/bulb connector to provide a greater surface area for heat to be dissipated from the lighting system. Examples of heat sink configurations and functionalities are provided in U.S. patent application Ser. No. 12/545,160 filed Aug. 21, 2009 and Ser. No. 13/110,457 filed May 18, 2011, the disclosures of which are hereby incorporated by reference herein in their entireties. It is not critical how the heat sink functionality is incorporated into the lens/bulb connector, so long as heat is efficiently dissipated from the lighting system during use.

The intermediate housing houses the LED and PCB for the lighting assembly. The connector/intermediate housing comprises means for joining the connector/intermediate housing with the bulb connector/lens securing means, and for joining the connector with the lamp cap/light assembly base. As shown, cooperative threading on the components to be joined can be used as the means for joining or an adhesive can be used or both.

Figure 28:
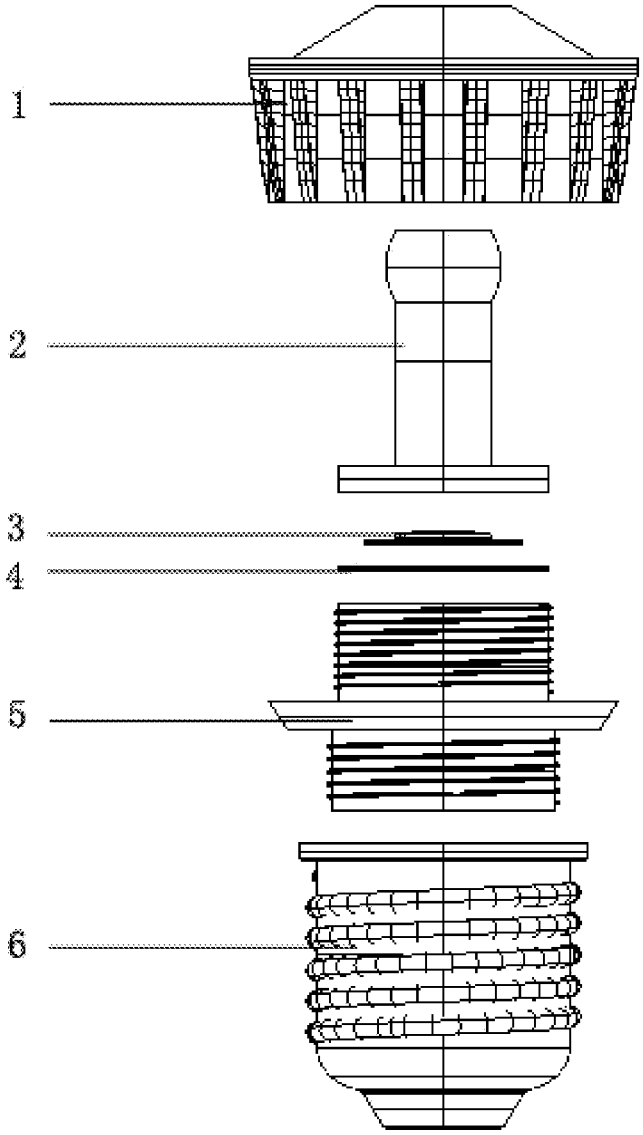
FIG. 28 is a schematic diagram of a disassembled candle light assembly.

FIG. 28 is a schematic diagram of a disassembled high voltage light embodiment of the invention, without a bulb and without a candle like base. In this embodiment, the lens extends upwardly and through a hole disposed in the lens/bulb connector to dissipate light at a desired viewing angle. The base of the lens is secured in place within the lighting system once the lens connector is joined with the intermediate housing. For example, and as shown, the lens can comprise a planar base which is retained by the lens connector when screwed onto the internal housing. The lighting system comprises one or more LEDs disposed and operably connected with a PCB. The lens is disposed over or around the LEDs in a manner to provide the desired light viewing angle. The lens can be in direct contact with the LEDs, however, in preferred embodiments there is a recess within the base of the lens for accommodating the LEDs such that there can be an air gap between the upper surface of the LEDs and the lower surface of the lens. This is preferred so that heat from the LEDs does not degrade the material of the lens. The intermediate housing comprises external threading on each end, one so that it may secure to the bulb/lens connector and the other end to the lamp cap. The lamp cap is operably configured for engaging with a socket of a lamp, which provides for electrical connection from a power source through the lamp cap to the LED.

Figure 29A:
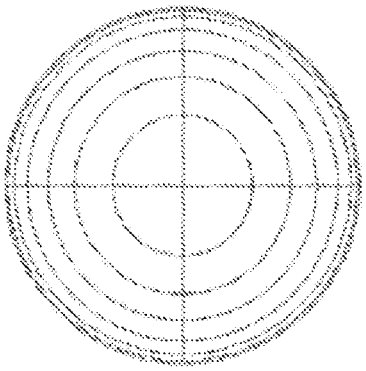
FIGS. 29A-C are schematic diagrams showing respectively a front elevation view, a side elevation view with a cross-sectional view of the bulb, and a rear elevation view of a candle light embodiment according to the invention.
Figure 29B:
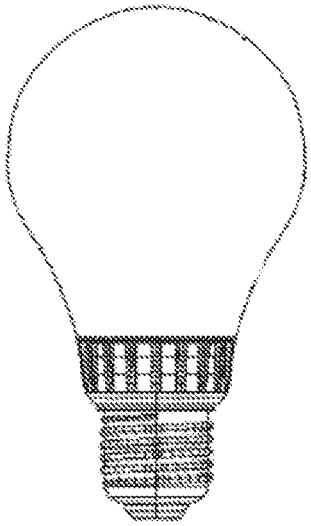
Figure 29C:
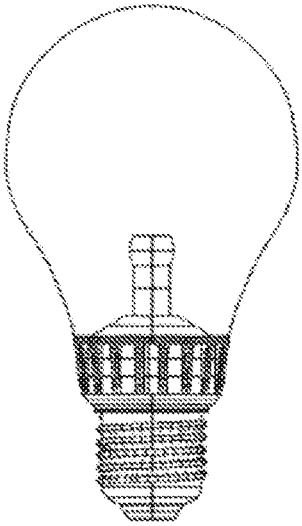
Figure 29D:
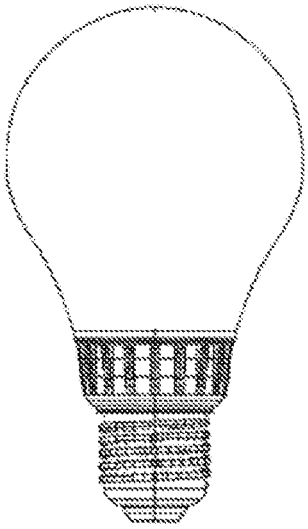
FIGS. 29D-E are schematic drawings providing a top planar view and a bottom planar view of the embodiment shown.
Figure 29E:
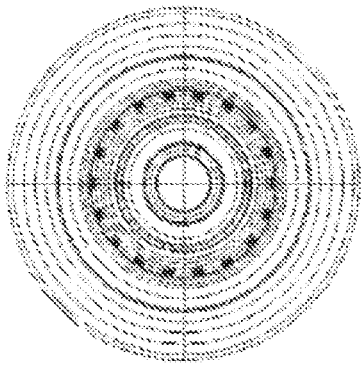

FIGS. 29A-C are schematic diagrams showing a front elevation view, a side cross-sectional view, and a rear elevation view of a high voltage light according to the invention, which comprises and E126 type base, a bulb and no candle like shaft. FIGS. 29D-E are respectively top and bottom planar views of the embodiment of FIGS. 29A-C.

FIG. 29A shows how the external components of the lighting assembly operate together to provide a high voltage lighting system with an E126 base. In this particular embodiment, the lens is housed within the bulb (which is optional) and is fixed in place by the bulb/lens connector/securing means. The bulb comprises structure for protecting and stabilizing the lens within the bulb in a desired position and/or the lens connector comprises such means. The bulb can be fixed to the lens connector in any manner including by cooperative threading on each component, or by adhesives. The lens connector also functions as a heat sink and comprises fins along its exterior surface. The lens connector is joined to an intermediate housing which together house the LED and PCB for the lighting assembly. The connector/intermediate housing comprises means for joining the connector/intermediate housing with the bulb/lens securing means, and for joining the intermediate housing with the lamp cap/light assembly base. Within the lamp cap can be electrical leads for connecting the lamp cap to the PCB for providing electrical power to the LEDs during use.

Figure 30:
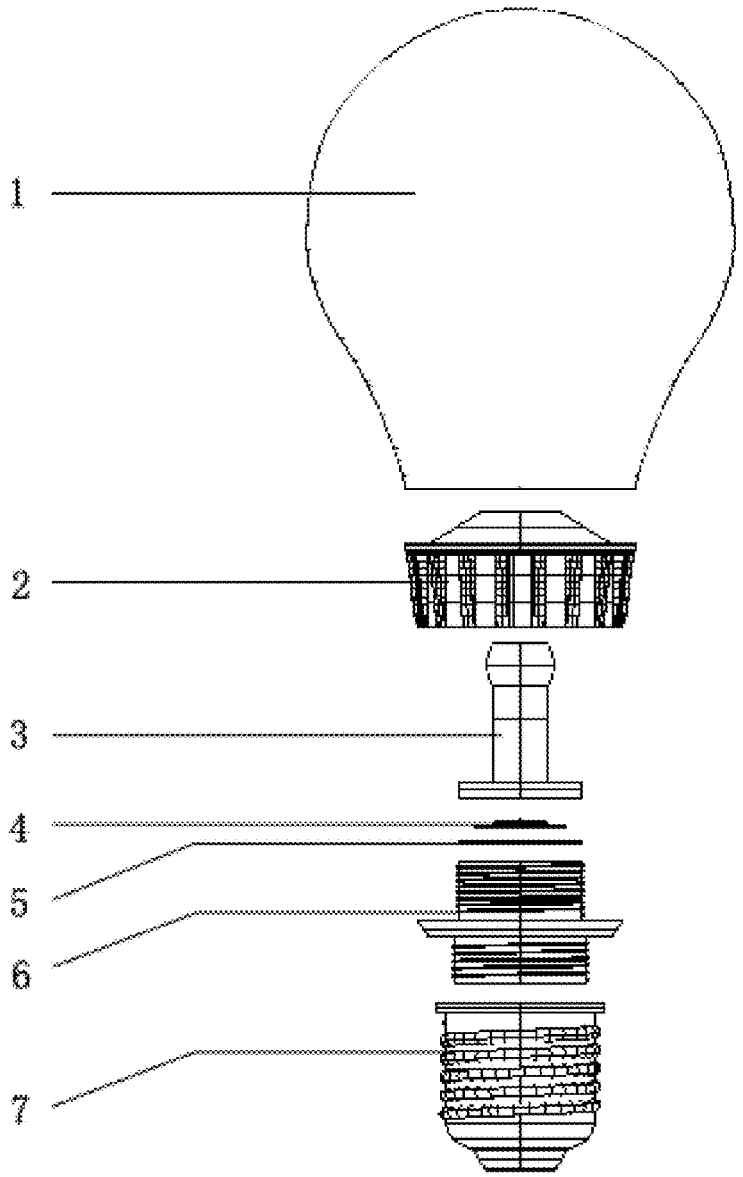
FIG. 30 is a schematic diagram of a disassembled candle light assembly.

FIG. 30 is a schematic diagram of a disassembled high voltage light, which is the embodiment also illustrated in FIGS. 29A-E. In this embodiment, there is a bulb and no candle like base/shaft. The internal components of the lighting system can cooperate together and with the external components of the system in a similar manner as described for the high voltage option provided in FIG. 28. One difference between the embodiments of FIG. 28 and FIG. 30 is the inclusion of a bulb in FIG. 30. The bulb in any embodiment is optional as is the shaft that encompasses the lamp cap. In both the embodiments of FIGS. 28 and 30, there is no housing for the lamp cap (shaft or heat sink that encompasses the lamp cap). It is within the skill of the art to add a shaft if desired for certain applications.

In summary, the lighting assemblies of the invention can comprise a low voltage candelabra type assembly or a low voltage E126 type assembly, or a high voltage candelabra type assembly or a high voltage E126 type assembly, each having a glass cover (bulb) and a candle like base (shaft), or each having no bulb and no candle type base, or each having no bulb but with a candle type base, or each having a bulb and no candle type base. Lighting systems according to the invention can comprise one or more of these types of assemblies in any combination.

Preferred characteristics for the candelabra candle light embodiments according to the invention can include one or more of a brightness (total light output) of about 160-240 lumens (lm), a color temperature of about 2700-3400K, a color-rendering index (CRI) of about 80 (based on a scale of 0-100), a total input power of about 4 watts, a power factor (<1) of about 0.6, and with dimmable capabilities. Preferred characteristics for the A-Lamp bulb (also referred to in this specification as an E126 type bulb) embodiments according to the invention can include a brightness of about 160-240 lumens (lm), a color temperature of about 2700-3400K, a CRI of about 80, a total input power of about 4 watts, a power factor (<1) of about 0.6, and with dimmable capabilities.

The light assemblies and candle light bulbs of the present invention are useful in many applications where electric lighting can be used. For example, the light assemblies and candle light bulbs according to the invention can be used in any residential or commercial application where such lighting is desired for decoration, backlighting or functional lighting, including for room lighting, such as in theatres, hospitals, airplanes, concert halls, stadiums, and auditoriums; elegant interior decoration, such as in restaurants, nightclubs, casinos, piers, malls, streets, stations, stages, offices and lobbies; homes, including as accent lighting in dining rooms, living rooms, functional and decorative lighting in entryways and recreational rooms; seasonal applications, such as for holiday decorations. The applications mentioned are merely representative of the numerous applications for which the light assemblies and candle light bulbs of the present invention may be applicable.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. It is intended that the specification and examples be considered as exemplary in nature and that variations that do not depart from the essence of the invention are intended to be within the scope of the invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A candle light assembly comprising:

a bulb enclosing a volume and having an opening at a longitudinal end, wherein the opening has an interior circumference which is threaded;

a heat sink base with an opening at a longitudinal end, wherein the opening has an interior circumference which is threaded;

a connector for securing the bulb to the heat sink base, which has an upper exterior threaded portion for communicating with the threaded bulb and a lower exterior threaded portion for communicating with the threaded base, wherein the connector is a heat sink; and an optics assembly comprising an LED, a lens, and a drive circuit for operating the LED;

wherein the interior circumference of the opening of the heat sink base is operably configured for receiving a lamp cap and a socket adapted to provide electrical connection of the LED to a power source, so that the socket is disposed entirely within the heat sink base.

2. The candle light assembly of claim 1, wherein the LED is mounted to an upper surface of the connector and the lens is mounted on the connector around a face of the LED.

3. The candle light assembly of claim 1, which during illumination of the LED experiences a temperature change of less than 40 degrees C.

4. The candle light assembly of claim 1, wherein the lens comprises PMMA (polymethyl methacrylate), is translucent, and provides a viewing angle of about 300 degrees.

5. The candle light assembly of claim 1, wherein the LED has a brightness of 455 lm.

6. The candle light assembly of claim 1, wherein the heat sink base has a length ranging from 50 mm to 250 mm.

7. The candle light assembly of claim 1, wherein the heat sink base has a length ranging from 100 mm to 200 mm, and an outer diameter ranging from 10 mm to 60 mm.

8. The candle light assembly of claim 7, wherein the heat sink base has a length of about 130 mm and an outer diameter of about 30 mm.

9. The candle light assembly of claim 1, wherein the heat sink base extends perpendicularly from a planar surface below the LED, and the drive circuit is disposed within the heat sink base.

* * * * *